US008588633B2

(12) United States Patent
Takemura

(10) Patent No.: US 8,588,633 B2
(45) Date of Patent: Nov. 19, 2013

(54) IMAGE FORMING APPARATUS

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 13/177,101

(22) Filed: Jul. 6, 2011

(65) Prior Publication Data

US 2012/0014702 A1 Jan. 19, 2012

(30) Foreign Application Priority Data

Jul. 14, 2010 (JP) ..... 2010-159467

(51) Int. Cl.
*G03G 15/00* (2006.01)
*G03G 15/01* (2006.01)
*G03G 15/20* (2006.01)

(52) U.S. Cl.
USPC ..... 399/46; 399/54; 399/67

(58) Field of Classification Search
USPC ..... 399/54
See application file for complete search history.

(56) References Cited

U.S. PATENT DOCUMENTS

| | | | | |
|---|---|---|---|---|
| 5,113,461 | A | 5/1992 | Ortiz, Jr. | |
| 7,877,053 | B2 | 1/2011 | Ng et al. | |
| 8,208,827 | B2 | 6/2012 | Sakata | |
| 2003/0007814 | A1 | 1/2003 | Richards | |
| 2005/0135851 | A1 | 6/2005 | Ng et al. | |
| 2006/0133870 | A1 | 6/2006 | Ng et al. | |
| 2006/0140677 | A1 | 6/2006 | Fukatsu et al. | |
| 2008/0160435 | A1 | 7/2008 | Lim et al. | |
| 2008/0298860 | A1 * | 12/2008 | Omata | 399/321 |
| 2009/0034998 | A1 | 2/2009 | Omata | |
| 2009/0067863 | A1 * | 3/2009 | Sakata | 399/66 |
| 2009/0069312 | A1 | 3/2009 | Trotter et al. | |
| 2009/0087221 | A1 | 4/2009 | Masui | |

(Continued)

FOREIGN PATENT DOCUMENTS

| | | | |
|---|---|---|---|
| EP | 2180375 | A2 | 4/2010 |
| EP | 2299329 | A1 | 3/2011 |
| JP | 2002-318482 | | 10/2002 |
| JP | 2006-251722 | A | 9/2006 |

OTHER PUBLICATIONS

Communication dated Apr. 6, 2011, forwarding a European Search Report dated Mar. 28, 2011, in European Application No. 11151536.7-1240.

(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a color toner image forming portion, a transparent toner image forming portion, a heating portion, an obtaining portion that obtains information on an area where a gloss level should partly be increased and an area where the gloss level should partly be decreased in an image, and a controller controls the color toner image forming portion and the transparent toner image forming portion to form the color toner images and a first partial transparent toner image on a recording material, controls the heating portion to heat the color toner images and the first partial transparent toner image on the recording material, controls the transparent toner image forming portion to form a second partial transparent toner image on the recording material, and controls the heating portion to heat the second partial transparent toner image on the recording material based on information obtained by the obtaining portion.

9 Claims, 24 Drawing Sheets

(56) References Cited

U.S. PATENT DOCUMENTS

| | | | | |
|---|---|---|---|---|
| 2009/0097046 | A1* | 4/2009 | Ohta et al. | 358/1.9 |
| 2009/0238616 | A1 | 9/2009 | Ciaschi | |
| 2009/0286177 | A1 | 11/2009 | Tyagi et al. | |
| 2010/0097666 | A1 | 4/2010 | Makino et al. | |
| 2011/0038655 | A1 | 2/2011 | Ng et al. | |
| 2011/0039202 | A1 | 2/2011 | Ng et al. | |
| 2011/0064436 | A1* | 3/2011 | Kimura et al. | 399/67 |
| 2011/0182607 | A1 | 7/2011 | Takemura | |

OTHER PUBLICATIONS

Communication dated Dec. 29, 2011, forwarding a European Search Report dated Dec. 16, 2011, in European Application No. 11173721.9-2209/2410383.

Chinese Office Action dated Aug. 15, 2013, in related Chinese Patent Application No. 201110197486.9.

* cited by examiner

IMAGE FORMING APPARATUS

BACKGROUND OF THE INVENTION

1. Field of the Invention

The present invention relates to an image forming apparatus including a color toner image forming portion that can form a color toner image and a clear toner image forming portion that can form a clear toner image.

2. Description of the Related Art

Recently there is proposed an electrophotographic image forming apparatus in which a clear toner (transparent toner) is used. Various expressions can be performed by use of the clear toner to improve an added value of an output. For example, Japanese Patent Laid-Open No. 2006-251722 discusses an image forming apparatus in which the clear toner is used.

In Japanese Patent Laid-Open No. 2006-251722, the image forming apparatus includes the color toner image forming portion that can form the color toner image and the clear toner image forming portion that can form the clear toner image, and the clear toner image is formed after the color toner image is formed on a recording material. According to the configuration of Japanese Patent Laid-Open No. 2006-251722, a gloss process is performed to the color toner image on a recording material.

However, an image forming apparatus that obtains the output, in which an area where a gloss is partly decreased with respect to surrounding glosses and an area where the gloss is partly increased with respect to the surrounding glosses are mixed on a surface of the output recording material, is not proposed yet.

The present invention provides an image forming apparatus that obtains the output in which the area where the gloss is partly decreased with respect to the surrounding glosses and the area where the gloss is partly increased with respect to the surrounding glosses are mixed.

SUMMARY OF THE INVENTION

An image forming apparatus according to an embodiment of the invention includes a color toner image forming means that can form a plurality of color toner images on a recording material, a transparent toner image forming means that can form a transparent toner image on the recording material, a heating means that heats the color toner images formed on the recording material, an obtaining means that obtains information on an area where a gloss level should partly be increased and an area where the gloss level should partly be decreased in an image on the recording material, and a controller that controls the color toner image forming means and the transparent toner image forming means to form the color toner images and a first partial transparent toner image on a surface of the recording material, controls the heating means to heat the color toner images and the first partial transparent toner image on the surface of the recording material, controls the transparent toner image forming means to form a second partial transparent toner image on the surface of the recording material, and controls the heating means to heat the second partial transparent toner image on the surface of the recording material based on the information obtained by the obtaining means.

Further features of the present invention will become apparent from the following description of exemplary embodiments with reference to the attached drawings.

DESCRIPTION OF THE EMBODIMENTS

Exemplary embodiments of the present invention will be described in detail with reference to the drawings. However, sizes, materials, shapes and relative positions of constituents described in the embodiments are appropriately changed according to configurations and various conditions of the apparatus to which the invention is applied. Therefore, the scope of the invention is not limited to the embodiments unless otherwise specified.

First Embodiment

Figure 1A:
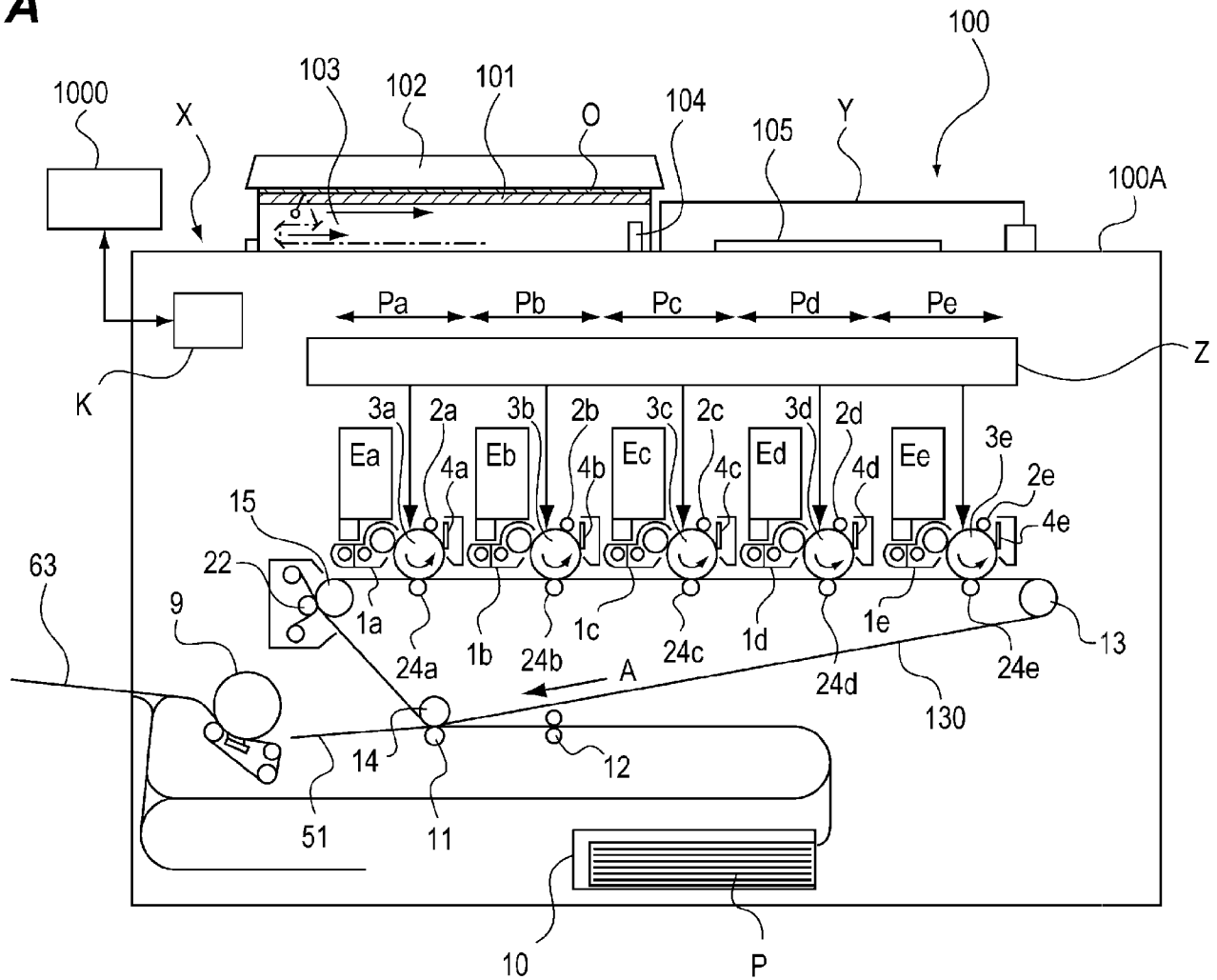
FIG. 1A is a sectional view illustrating a configuration of an image forming apparatus according to a first embodiment of the invention.

FIG. 1A is a sectional view illustrating a configuration of an image forming apparatus 100 according to a first embodiment of the invention. The image forming apparatus 100 is a full-color electrophotographic apparatus in which an electrophotographic image forming process is used, and the image forming apparatus 100 is a multi-function peripheral that acts as a copying machine, a printer, and a facsimile. As illustrated in FIG. 1A, the image forming apparatus 100 includes an image forming apparatus body (hereinafter simply referred to as "apparatus main body") 100A, and plural image forming portions Pa, Pb, Pc, Pd, and Pe that form images are provided in the apparatus main body 100A. The image forming portions Pa to Pe include a photosensitive drum that is an "image bearing member" and a primary transfer charger 24 that is a "transfer device". At least the photosensitive drum 3 is included in a process cartridge, and the photosensitive drum 3 may be incorporated as the process cartridge in the apparatus main body 100A.

First to fifth electrophotographic image forming portions (hereinafter referred to as image forming portions Pa to Pe) are incorporated in the apparatus main body 100A in the horizontal order from the left to the right. The image forming portions Pa to Pe are used in clear, yellow, magenta, cyan, and black in the order from the left. The image forming portion Pa that is a "transparent toner image forming portion" can form a clear toner image that is a "transparent toner image" on a recording material P. The image forming portions Pb to Pe that are "color toner image forming portions" can form plural color toner images on the recording material P. An original reader (image scanner) X and an operation display Y are disposed on an upper surface side of the apparatus main body 100A. An operator inputs a command through the operation display Y, and the operator is informed of a state of the apparatus by the operation display Y.

In the original reader X, an original pressing plate 102 is attached to an original base plate glass (hereinafter referred to as glass 101) in an openable way. For a copy (original duplication) mode, a user places a color original (or monochrome original) O to be copied on the glass 101 according to a predetermined placement standard while an image surface faces a downward direction, and the original O is covered with the original pressing plate 102. Alternatively, an automatic original feeding apparatus (ADF or RDF) may be used instead of the original pressing plate 102 to automatically feed a sheet-like original onto the glass 101.

A copy start key 400 (see FIG. 2A) is pressed after a desired copy condition is set by the operation display Y. Therefore, a moving optical system 103 is driven along a lower surface of the glass 101 to optically scan the downward-facing image surface of the original O on the glass 101. Original scanning light forms an image on a CCD 104 that is a photoelectric conversion element (solid-state image pickup element), and the image is read while color separation is performed by three primary colors of RGB (red, green, and blue). Each of read RGB signals is input to an image processing portion 105. In the information input to the image processing portion 105, pieces of electric image information processed into Y, M, C, and K are transmitted to a controller K. The controller K controls a laser scanning mechanism Z to output laser beams, which are modulated according to the pieces of electric image information, to the first to fifth image forming portions Pa to Pe. The detailed operation display Y is described below.

For a printer mode, the electric image information is input to the controller K of the apparatus main body 100A from a personal computer that is an external host device 1000, whereby the image forming apparatus 100 acts as a printer. For a facsimile receiving mode, the electric image information is input to the controller K of the apparatus main body 100A from a facsimile machine of the other party that is the external host device 1000, whereby the image forming apparatus 100 acts as a facsimile receiver. For a facsimile transmitting mode, the electric image information of the original read in the opto-electric manner by the original reader X is input to the controller K from the image processing portion 105, and the electric image information is transmitted to the facsimile machine of the other party, whereby the image forming apparatus 100 acts as a facsimile transmitter.

At this point, an image output method includes the following methods. First, there is a "normal one-time fixing and output mode". The normal one-time fixing and output mode is an image formation mode in which an image formation object (full-color image formation object, monochrome image formation object, and single-color image formation object) of the image, in which only the color toner is used, is output through a one-time fixing process.

Second, there is a "gloss process one-time fixing and output mode". The gloss process one-time fixing and output mode is an image formation mode in which the image formation object (full-color image formation object, monochrome image formation object, and single-color image formation object) of the image (clear image) wholly or partly having the gloss is output through the one-time fixing process.

Third, there is a "gloss process two-time fixing and output mode". The gloss process two-time fixing and output mode is an image formation mode, in which the image forming operation is performed similarly to the normal one-time fixing and output mode and then a second fixing operation is performed to output the image formation object of the image (clear image) wholly or partly having the gloss. As used herein, the image formation object includes the full-color image formation object, the monochrome image formation object, and the single-color image formation object.

Fourth, there is a "high-and-low-gloss mixture output mode". The high-and-low-gloss mixture output mode is an image formation mode, in which the image forming operation is performed similarly to the gloss process one-time fixing and output mode, the clear image formation is performed, and then the second fixing operation is performed to output the image formation object of the image (clear image) in which a part having the high gloss and a part having the low gloss are mixed. As used herein, the image formation object includes the full-color image formation object, the monochrome image formation object, and the single-color image formation object. The high-and-low-gloss mixture output mode will be described in detail.

Figure 1B:
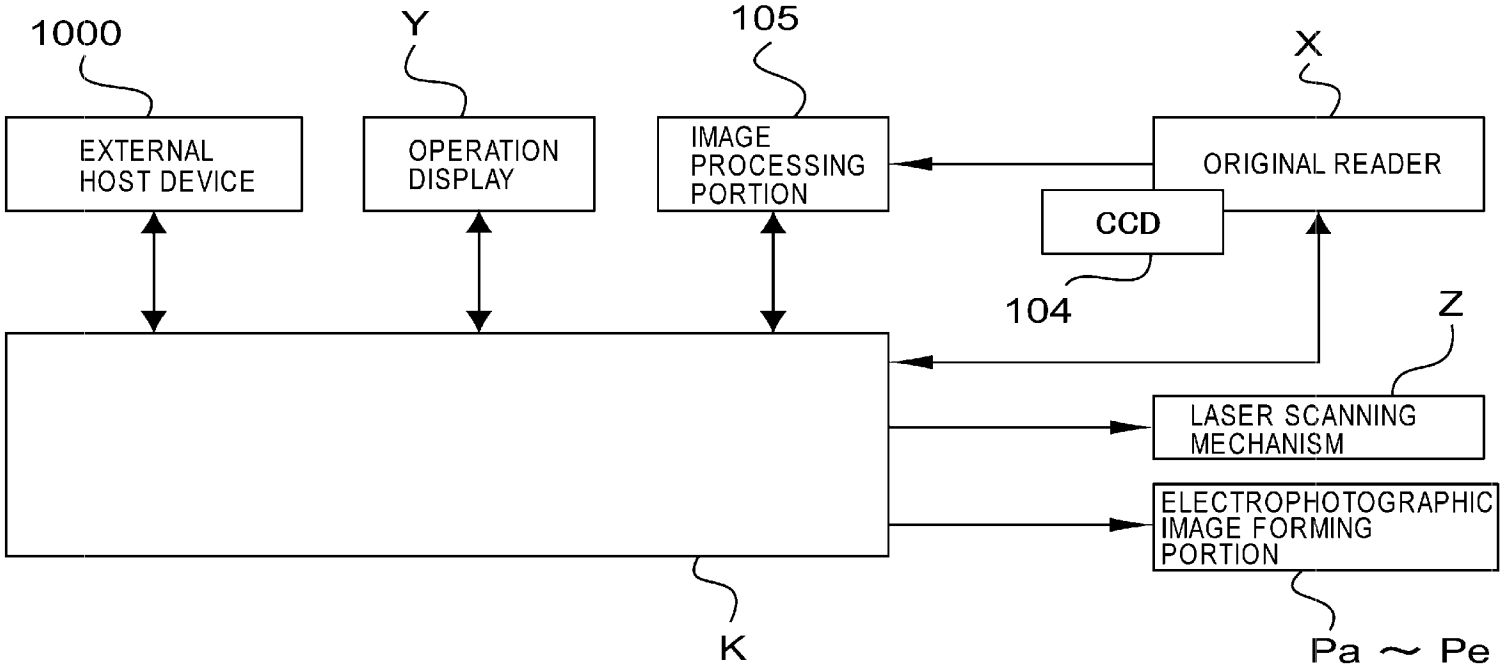
FIG. 1B is a block diagram illustrating the image forming apparatus of the first embodiment.

FIG. 1B is a block diagram illustrating an outline of a control system. As illustrated in FIG. 1B, the controller K (control circuit and control board) totally controls the image forming apparatus 100. The external input device (external host device) 1000 is a personal computer, a facsimile machine, and the like, and electrically connected to the controller K through an interface.

The controller K can perform the following control. The controller K controls the image forming portion Pa and the image forming portions Pb to Pe to form the partial clear toner image and the color toner image on a surface of the recording material P based on a gloss level information signal (information obtained in an obtaining portion by the controller) specified by the touch panel 406 (see FIG. 2A). The controller K controls a fixing device 9 to fix the color toner image and the partial clear toner image on the surface of the recording material P.

Figure 2A:
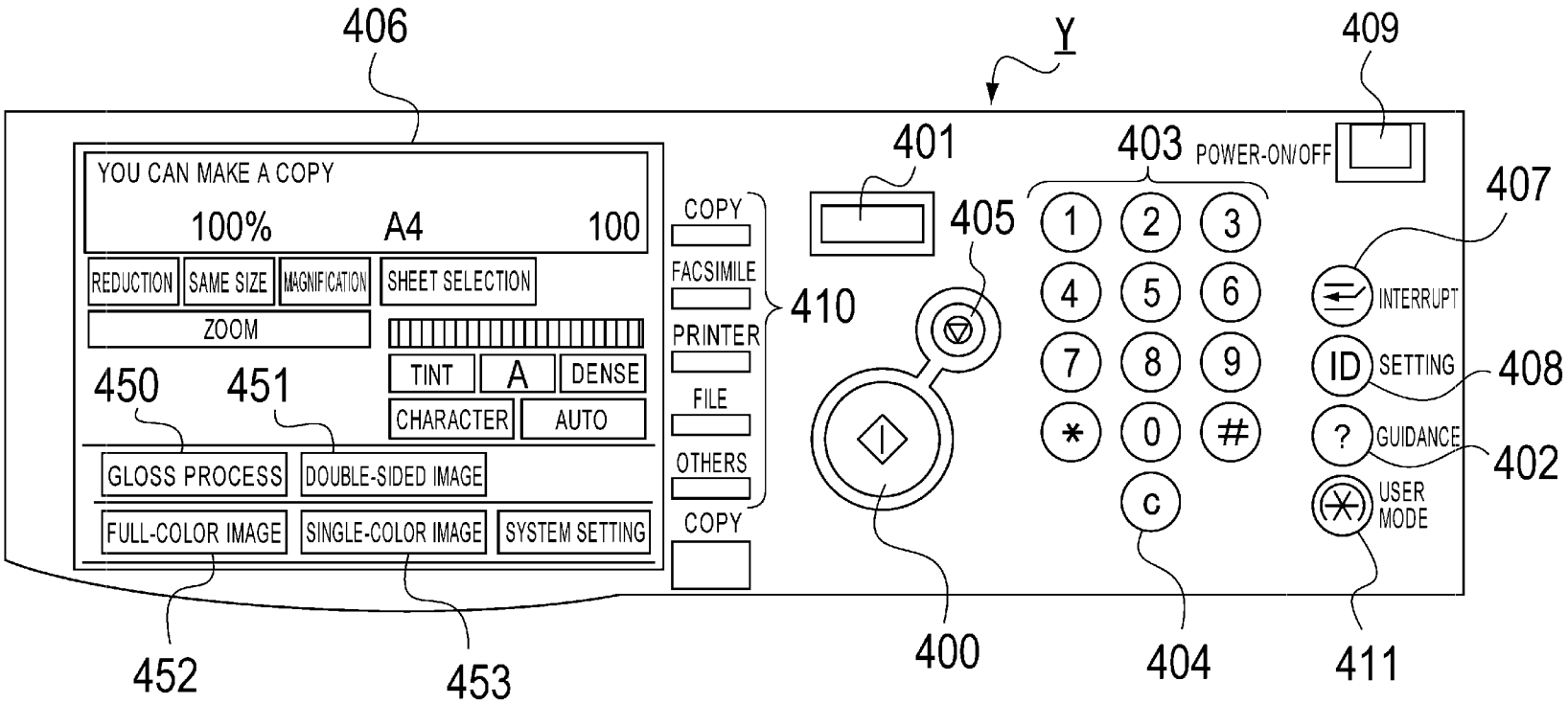
FIGS. 2A and 2B are plan views illustrating a configuration of an operation display.

The controller K controls the image forming portions Pb to Pe to form the color toner image on the surface of the recording material P based on the gloss level information signal specified by the touch panel 406 (see FIG. 2A). The controller K controls the fixing device 9 to fix the color toner image on the surface of the recording material P. Then the controller K controls the image forming portion Pa to form the partial clear toner image on the surface of the recording material P, and controls the fixing device 9 to fix the color toner image and the partial clear toner image on the surface of the recording material P.

The controller K controls the image forming portions Pb to Pe and the image forming portion Pa to form the color toner image and the first partial clear toner image on the surface of the recording material P based on the gloss level information signal specified by the touch panel 406 (see FIG. 2A). The controller K controls the fixing device 9 to fix the color toner image and the first partial clear toner image on the surface of the recording material P. Then the controller K controls the image forming portion Pa to form the second partial clear toner image on the surface of the recording material P. The controller K controls the fixing device 9 to fix the second partial clear toner image on the surface of the recording material P.

The controller K controls the image forming portion Pa according to a partly changing gloss level to change a clear toner load amount based on the gloss level information signal (information obtained in the obtaining portion by the controller) specified by the touch panel 406.

Referring to FIG. 1A, an operation and process of the image forming apparatus 100 will be described below. The first to fifth image forming portions Pa to Pe are arrayed in the apparatus main body 100A, and the toner images having different colors are formed through an electrostatic image, development, and transfer processes.

The image forming portions Pa, Pb, Pc, Pd, and Pe include the electrophotographic photosensitive drums (hereinafter referred to as photosensitive drums 3*a*, 3*b*, 3*c*, 3*d*, and 3*e*) that are the dedicated image bearing members, respectively. The toner images having the clear (Cl), yellow (Y), magenta (M), cyan (C), and black (K) colors are formed on the photosensitive drums 3*a*, 3*b*, 3*c*, 3*d*, and 3*e*, respectively. An intermediate transfer belt 130 that is an intermediate transfer member is disposed adjacent to the photosensitive drums 3*a* to 3*e*, the toner images having the colors formed on the photosensitive drums 3*a* to 3*e* are primary-transferred onto the intermediate transfer belt 130, and the toner images are transferred onto the recording material P by a secondary transfer portion. After the toner images are fixed by heating and pressurization with the fixing device 9 that is a heating (fixing) portion, the recording material P to which the toner images are transferred is discharged to the outside of the apparatus main body 100A as the recording image.

Drum chargers 2*a*, 2*b*, 2*c*, 2*d*, and 2*e* and development devices 1*a*, 1*b*, 1*c*, 1*d*, and 1*e* are provided in outer circumferences of the photosensitive drums 3*a*, 3*b*, 3*c*, 3*d*, and 3*e*, respectively. Primary transfer chargers 24*a*, 24*b*, 24*c*, 24*d*, and 24*e* and cleaners 4*a*, 4*b*, 4*c*, 4*d*, and 4*e* are provided in the outer circumferences of the photosensitive drums 3*a*, 3*b*, 3*c*, 3*d*, and 3*e*, respectively. A light source (not illustrated) and a polygon mirror (not illustrated) are disposed in an upper part of the apparatus main body 100A.

The laser beam emitted from the light source is scanned by rotating the polygon mirror, a flux of the scanning light is deflected by a reflecting mirror, and the light flux is focused on generatrices of the photosensitive drums 3*a*, 3*b*, 3*c*, 3*d*, and 3*e* with an fθ lens to expose the photosensitive drums 3*a*, 3*b*, 3*c*, 3*d*, and 3*e*. Therefore, electrostatic images are formed on the photosensitive drums 3*a*, 3*b*, 3*c*, 3*d*, and 3*e* according to image signals.

The development devices 1*a*, 1*b*, 1*c*, 1*d*, and 1*e* are filled with predetermined amounts of toners having clear (Cl), yellow (Y), magenta (M), cyan (C), and black (K) colors that are developers by a supplying unit (not illustrated). The development devices 1*a* to 1*e* develop the electrostatic images on the photosensitive drums 3*a* to 3*e* to form the clear toner image, a yellow toner image, a magenta toner image, a cyan toner image, and a black toner image. The intermediate transfer belt 130 rotates in an arrow direction at the same circumferential speed as that of the photosensitive drums 3*a* to 3*e*.

The clear toner image that is a first color image formed and borne on the surface of the photosensitive drum 3*a* is intermediately-transferred as follows. The first color clear image is intermediately-transferred to an outer circumferential surface of the intermediate transfer belt 130 by an electric field and a pressure, which are formed by a primary transfer bias applied to the intermediate transfer belt 130, through a process in which the first color clear image passes through a nip portion between the photosensitive drum 3*a* and the intermediate transfer belt 130.

A secondary transfer roller 11 is disposed in parallel with the intermediate transfer belt 130 while being in contact with a lower surface part of the intermediate transfer belt 130. A secondary transfer bias source applies a desired secondary transfer bias to the secondary transfer roller 11. A composite color toner image that is transferred and superimposed onto the intermediate transfer belt 130 is transferred to the recording material P as follows. That is, the recording material P is fed from a sheet cassette 10 to a nip between the intermediate transfer belt 130 and the secondary transfer roller 11 through a registration roller 12 and a pre-transfer guide in predetermined timing, and the secondary transfer bias is simultaneously applied from the secondary transfer bias source. The composite color toner image is transferred from the intermediate transfer belt 130 to the recording material P by the secondary transfer bias. Similarly, the yellow toner image that is a second color, the magenta toner image that is a third color, the cyan toner image that is a fourth color, and the black toner image that is a fifth color are sequentially transferred and superimposed onto the intermediate transfer belt 130 to form the composite color toner image corresponding to the intended color image.

After the primary transfer, residual transfer toners on the photosensitive drums 3*a*, 3*b*, 3*c*, 3*d*, and 3*e* are cleaned and removed by the cleaners 4*a*, 4*b*, 4*c*, 4*d*, and 4*e* to prepare the subsequent electrostatic image formation. The residual toner and other foreign matters on the intermediate transfer belt 130 are wiped off by abutting a cleaning web (non-woven fabric cloth) 22 (not illustrated) on the surface of the intermediate transfer belt 130.

The fixing device 9 that is the "heating portion" thermally fixes (heats) the toner image formed on the recording material P. The recording material P to which the toner image is transferred is introduced to the fixing device 9 that is the fixing portion through a conveyance path 51 provided between the secondary transfer portion and the fixing device 9, the toner image is fixed on the recording material P by applying the heat and pressure, and the recording material P is discharged as a full-color print to a discharge tray 63.

For the normal one-time fixing and output mode, in the image forming operation, the image is not formed by the clear toner, but the images may be formed by other color toners and output in the similar manner.

For the gloss process one-time fixing and output mode, the clear image can be output through the processes in the image forming operation.

For the gloss process two-time fixing and output mode, the recording material P to which the toner images formed only by the color toners are transferred is introduced to the fixing device 9 through the conveyance path 51 provided between the secondary transfer portion and the fixing device 9. After the toner images are fixed on the recording material P by applying the heat and pressure, the recording material P is introduced to the secondary transfer portion again through the conveyance path 51 for the second image formation. The clear toner image formed on the intermediate transfer belt 130 is transferred to the recording material P through the similar image forming process, the recording material P is subjected to the second fixing process through the conveyance path 51, and the recording material P is output as the image formation output.

For the high-and-low-gloss mixture output mode, first the image forming operation is performed similarly to the gloss process one-time fixing and output mode. Then the obtained image is introduced to the conveyance path for the second image formation and introduced to the secondary transfer portion again. The clear toner image formed on the intermediate transfer belt 130 is transferred to the recording material P through the similar image forming process, the recording material P is subjected to the second fixing process through the conveyance path 51, and the recording material P is output as the image formation output.

The image forming process and fixing process in the high-and-low-gloss mixture output mode are described below.

FIG. 2A is a plan view illustrating a configuration of the operation display Y. A copy start key 400 is a key that is used to provide an instruction to start the duplication. A reset key 401 is a key that is used to return to a standard mode, and a "monochrome, single-side, and non-clear" image is formed in the standard mode. A guidance key 402 is a key that is pressed when a guidance function is used. A numerical keypad 403 is a key that is used to input a numerical value such as the number of set sheets. A clear key 404 is a key that is used to clear the numerical value. A stop key 405 is a key that is used to stop the copy during continuous copy. Settings of various modes and a printer state are displayed on a liquid crystal display and the touch panel 406.

An interrupt key 407 is a key that is used to make an emergency copy by interrupting the continuous copy or use as the facsimile machine or the printer. A security code key 408 is a key that is used to manage the number of copy sheets individually or sectorally. A soft switch 409 is a key that is used to turn on and off the apparatus main body 100A. A function key 410 is a key that is used to change the function of the image forming apparatus 100. A user mode key 411 is a key that is used to enter a user mode in which the user sets an item such as on and off of an automatic cassette change and a change of a setting time necessary to enter an energy saving mode. A gloss process mode (gloss-up mode, gloss-down mode, and mixing mode) selection key 450, a double-sided image formation mode selection key 451, a full-color image formation mode selection key 452, and a single-color image formation mode selection key 453 are also provided in the operation display Y. The case in which the gloss process mode selection key 450 is selected in the touch panel 406 is described below.

Figure 2B:
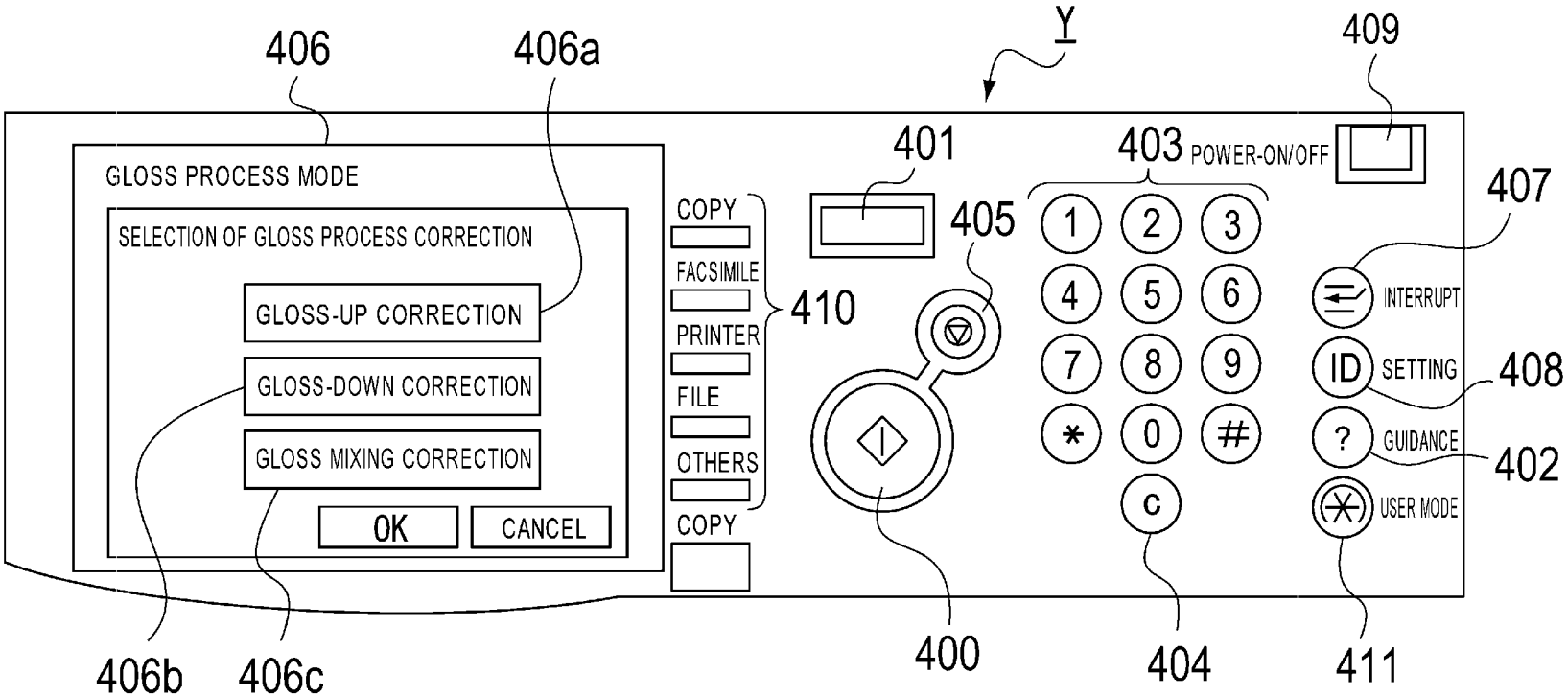

FIG. 2B is a plan view illustrating a configuration of the touch panel 406 on which selection item keys of gloss process correction are displayed in selecting the gloss process mode selection key 450. When the user selects the gloss process mode selection key 450 (see FIG. 2A), selection items of the gloss process correction are displayed in the touch panel 406 as illustrated in FIG. 2B. Mode keys such as a gloss-up correction key, a gloss-down correction key, and a gloss mixing correction key are displayed as the selection items of the gloss process correction.

The gloss-up correction key is used to increase the gloss of the area selected by the user compared with those of other areas. The gloss-down correction key is used to decrease the gloss of the area selected by the user compared with those of other areas. The gloss mixing correction key is used to output the image, in which both the area where the gloss of the area specified by the user is increased compared with those of other areas and the area where the gloss of the area specified by the user is decreased compared with those of other areas are mixed. The image forming process and fixing process in selecting each mode key are described below. The touch panel 406 that is a "specifying portion" provided in the operation display Y is a panel through which the user can specify the gloss level information to partly increase the gloss level of a predetermined area in the output image. The touch panel 406 is a panel through which the user can specify the gloss level information to partly decrease the gloss level of the predetermined area in the output image. The touch panel 406 is a panel through which the user can specify the gloss level information to partly increase or decrease the gloss level of the predetermined area in the output image. An external terminal, such as a PC, which can transmit information to the image forming apparatus through a network may be used to specify the area where the gloss is partly increased and the area where the gloss is partly decreased on the same image surface of one sheet (recording material). In the image forming apparatus, the controller that acts as the obtaining portion obtains the information on the gloss level specified by the touch panel 406 or the PC. For example, as the obtaining means, a circuit or an interface corresponds. For example, the obtaining means is a part of the controller K.

The toners used in the development devices 1*a* to 1*e* will be described below. A toner made of a polyester resin is used. Although the toner can be produced by a crushing method, preferably methods such as a suspension polymerization method, an interface polymerization method, and a dispersion polymerization method, in which the toner is directly produced in a medium are cited as the toner producing method. There is no particular limitation to a toner composition and the toner producing method.

In the present embodiment, a method in which the same polyester resin as the color toner is used without mixing color pigment is used as a clear toner producing method. There is no particular limitation to a glass transition temperature (Tg). When a kind or a molecular weight of the clear toner resin are changed, a melting characteristic varies to obtain a different gloss even if the same fixing condition is adopted.

Accordingly, a clear toner is produced using a polyester resin having the glass transition temperature lower than that of the color toner, and the clear toner may be used while having the gloss higher than that of the color toner. On the contrary, a hardly-melted clear toner is produced using a polyester resin having the glass transition temperature higher than that of the color toner, and the clear toner may be used while having the gloss lower than that of the color toner.

The clear toner is produced such that the glass transition temperature (Tg) of the clear toner becomes equal to that of the color toner. When the clear toner is fixed on the same condition as the color toner, the same gloss level as the color toner can be obtained.

An image data amount will be described below. The image data amount means a data amount per pixel of the image information in which the original image is separated into Y, M, C, and K colors. The maximum image data amount of each color is expressed as 100%. A toner amount for the image formation is computed according to the image data amount of 0 to 100%.

The toner amount means an amount of toner per pixel of the image formed on the recording material P. Similarly to the image data amount, the toner amount is also expressed in terms of 0 to 100%. A toner weight in forming the image in 1 $cm^2$ is referred to as a load amount. The toner amount of 100% in a single color becomes the maximum density of the color. Based on the maximum density, main body process conditions such as a development condition are determined such that image density linearly becomes a range of 0 to 100% according to the toner amount of 0 to 100%.

For example, the maximum density depends on a toner characteristic, a fixing condition of the fixing device, and a kind of the recording material P. The maximum density also depends on image design how much maximum density of each color is determined. At this point, a process speed is set to 200 mm/s. A control temperature of the fixing device 9 is set to 160° C.

In such cases, the density of 1.5 is obtained in each color at the color toner load amount of 0.4 $mg/cm^2$ using plain paper (paper gloss of about 6%) having a basis weight of 80 $g/m^2$. The toner load amount of 0.4 $mg/cm^2$ is set to the maximum load amount of one color.

Based on the maximum load amount of one color, image correction such as so-called gamma correction is performed to the image data amount of each color of the image to be output such that color tones are matched with each other, and toner amounts are computed by pixels, respectively. Then, the image is formed. Various colors are expressed by overprinting the toner of each color. At this point, in principle, the color toner image information becomes up to the image data amount of 400%. The clear toner image information of 100% is added. Not the density but the load amount at which the desired gloss level is obtained is set in the clear toner image.

Figure 2C:
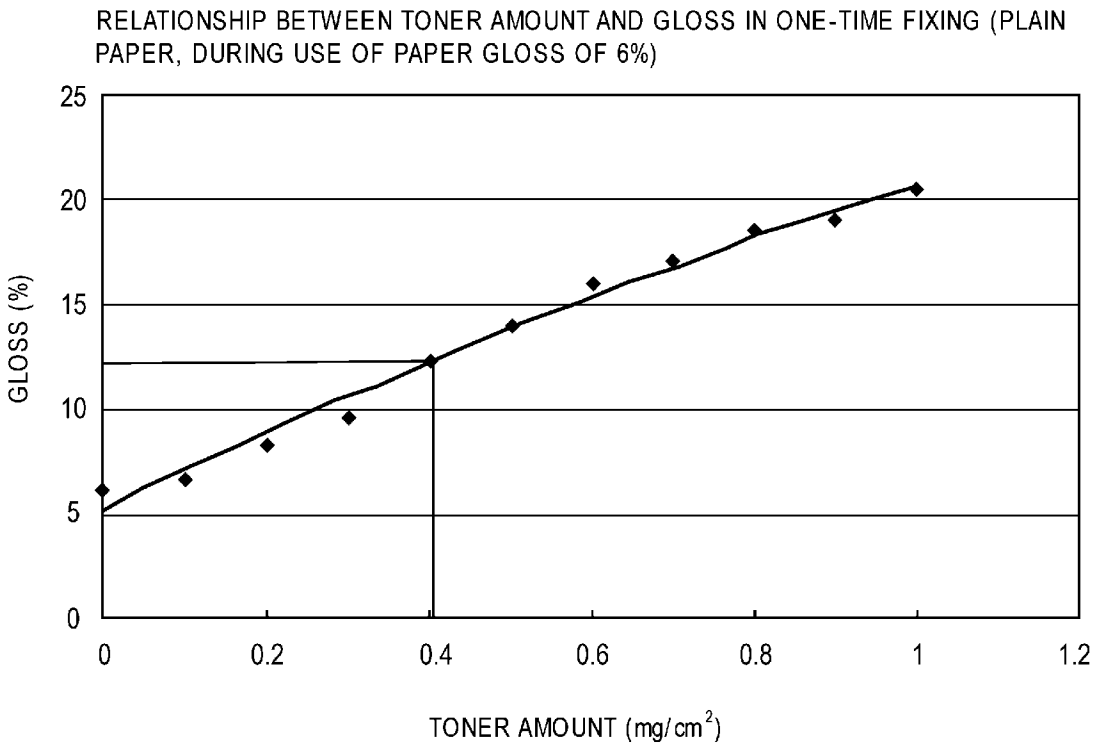
FIG. 2C is a graph illustrating a relationship between a toner amount and a gloss.

FIG. 2C is a graph illustrating a relationship between the toner amount and the gloss in the one-time fixing mode. When the image is formed in the plain paper (paper gloss of about 6%) having the basis weight of 80 $g/m^2$ by the clear toner, the clear toner gloss of about 12% is obtained at the load amount of 0.4 $mg/cm^2$ by a 60-degree gloss measurement. A handy gloss meter (PG-1M, product of NIPPON DENSHOKU INDUSTRIES CO., LTD.) is used in the gloss measuring method (in conformity with JIS Z 8741, mirror surface gloss level-measuring method).

For coated paper, the process speed is set to 100 mm/s, and the control temperature of the fixing device 9 is set to 160° C. In such cases, the density of 1.7 is obtained in each color at the toner load amount of 0.4 $mg/cm^2$ using A2 gloss coated paper having a basis weight of 150 $g/m^2$.

When the image is formed in the A2 gloss coated paper (paper gloss of 20%) having the basis weight of 150 $g/m^2$ by the clear toner, the clear toner gloss of about 40% is obtained at the load amount of 0.4 $mg/cm^2$ by the 60-degree gloss measurement.

It is not necessary that the maximum load amount of the clear toner is matched with the maximum load amount of the color toner, but the load amount at which the desired gloss is obtained may be set to the maximum load amount.

As described above, in principle, the color toner image information becomes up to the image data amount of 400%. However, the toner of 400% is not used in the actual image formation, but preferably the maximum image data amount of the color image is set by a method such as UCR and GCR so as to become 180% to 240%.

The UCR means Under Color Removal. When the color original is separated into four colors, a gray component is generated in a part in which the C (cyan), M (magenta), and Y (yellow) colors are superposed. The UCR is a method that is used to replace the gray component with a black plate (Bk plate) in order to replace the gray component having a certain level density or more with the black plate to reduce the total image data amount.

The GCR means Gray Component Replacement. In the color separation image, a point having the same ratio of the C (cyan), M (magenta), and Y (yellow) becomes black or gray. A ratio of a halftone dot can be reduced by replacing the part with K (black), thereby reducing a total area ratio of the halftone dot.

In the present embodiment, using the UCR and the GCR, the maximum total toner amount is set to 200% in the area where the image is formed only by the color toner, and the maximum total toner amount in which the color toner amount and the clear toner amount are added is set to 240%. The fixing device 9 is designed such that the toner amount of 240% can be fixed once.

Figure 3:
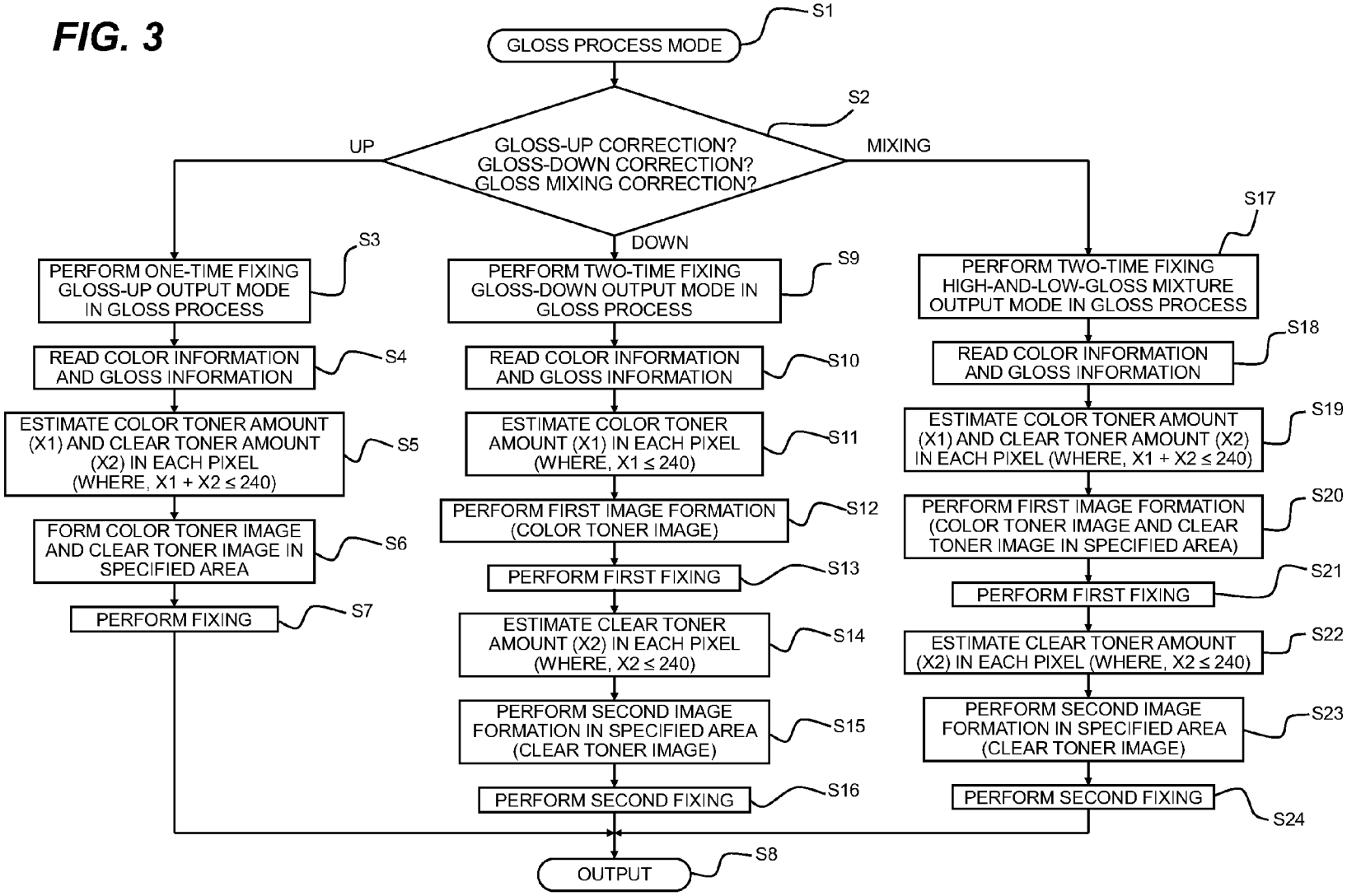
FIG. 3 is a flowchart illustrating a control process performed by a controller when a gloss process output mode is selected.

FIG. 3 is a flowchart illustrating a control process performed by the controller K when the gloss process output mode is selected. When the image formation object in which the clear toner image is formed while superimposed on the color toner image is output in the copy mode, the gloss process mode selection key 450 (see FIG. 2A) of the operation display Y is selected. Other desired copy conditions are set.

In the gloss process output mode, the clear toner image is formed by the first image forming portion Pa in addition to the color toner images formed by the second to fifth image forming portions Pb to Pe.

In the copy mode, the clear image of the original O cannot be read by the original reader (image scanner) X. Therefore, the image whose gloss is increased or decreased with respect to the surrounding color toner images is previously output in black and white. The image can be scanned by the original reader X after the mode is set to the read mode such that black and white image part of the original is recognized as a gloss specifying image by the operation display Y that is the operation portion. At this point, the gloss specifying image is classified into images distinguished or specified as objects such as a character and the color information or images distinguished or specified as a certain area, and the gloss specifying image is appropriately determined.

When the gloss process mode selection key 450 (see FIG. 2A) is selected in the copy mode, the mode keys of the gloss-up correction key, the gloss-down correction key, and the gloss mixing correction key are displayed (see FIG. 2B). The user selects one of the gloss-up correction key, the gloss-down correction key, and the gloss mixing correction key. The user places the color information image, the gloss-up specifying image, or the gloss-down specifying image on the original reader X. The original reader X reads the image (see FIG. 4A) for reading the pieces of color information on Y (yellow), M (magenta), C (cyan), and K (black). Alternatively, the original reader X reads the gloss-up specifying image (see FIG. 5A) and the gloss-down specifying image (see FIG. 5B), which are previously produced as the monochrome image to perform the gloss process. Alternatively, the original reader X reads the gloss-up specifying image (see FIG. 5A) and the gloss-down specifying image (see FIG. 5B). This will be described in detail below.

Figure 4A:
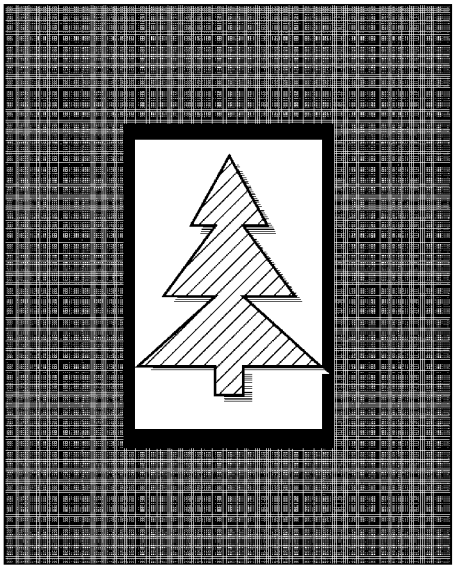
FIG. 4A is a view illustrating an image used to read color information.
Figure 4B:
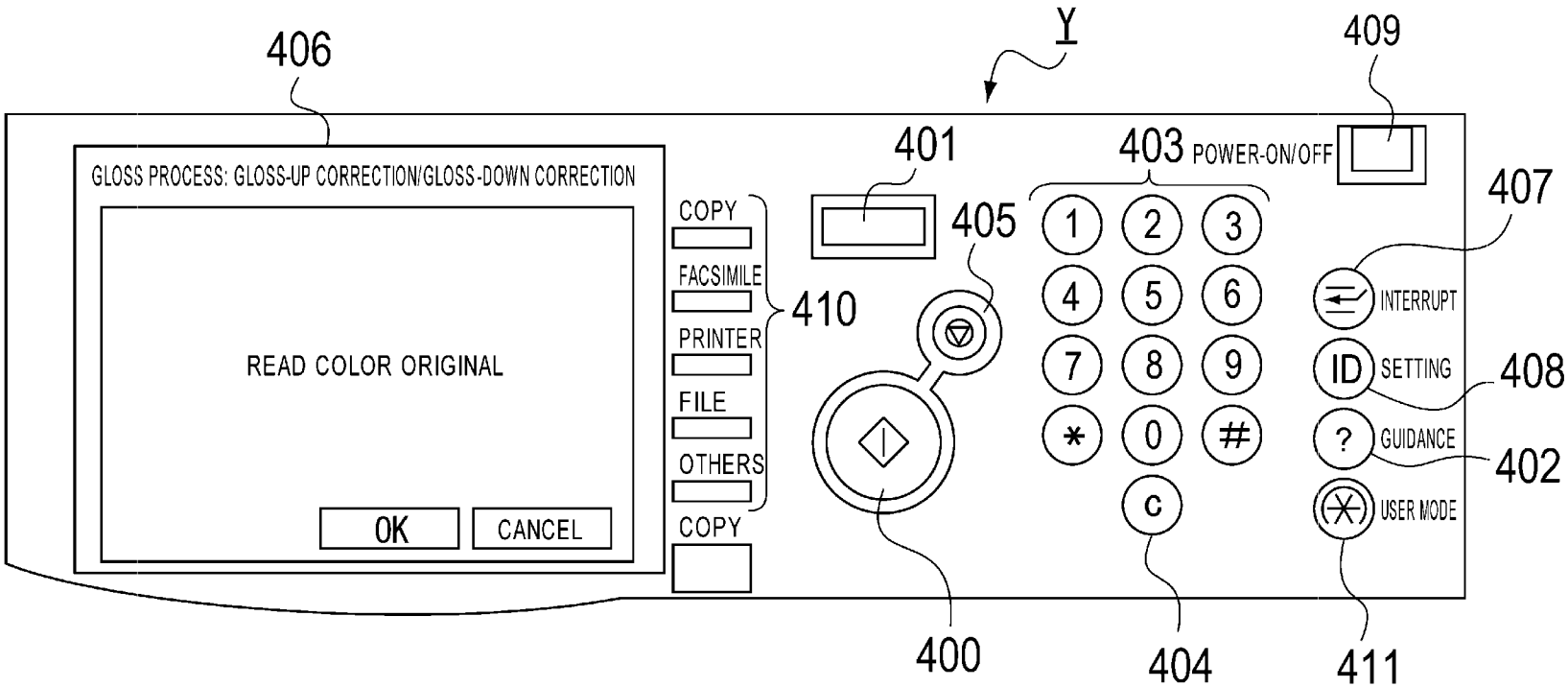
FIG. 4B is a plan view illustrating a configuration of the operation display.

FIG. 4A is a view illustrating an image used to read the color information, and FIG. 4B is a plan view illustrating a configuration of the operation display Y when the color information is read. The case in which the area where the gloss is increased and the color image are obtained or the case in which the area where the gloss is decreased and the color image are obtained will be described with reference to FIGS. 4A and 4B. For example, the user selects the gloss-up correction key or the gloss-down correction key on the gloss process mode screen illustrated in FIG. 2B. Therefore, an instruction to "read the color original" illustrated in FIG. 4B is displayed on the touch panel 406. The user places the image illustrated in FIG. 4A on the original reader X to press an "OK" key illustrated in FIG. 4B, thereby completing the read of the color information on the color original.

Figure 5A:
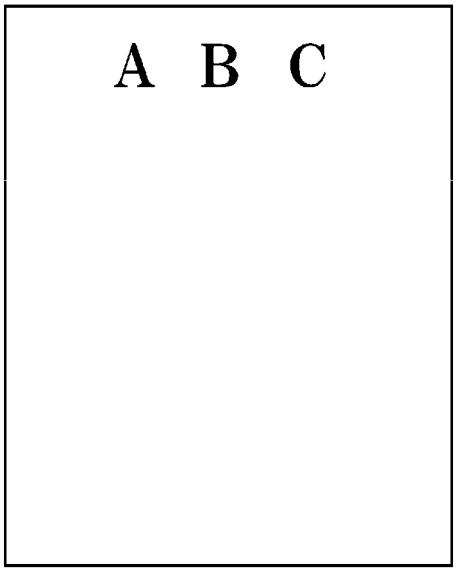
FIGS. 5A and 5B are plan views illustrating gloss-up specifying image and gloss-down specifying image, respectively.
Figure 5B:
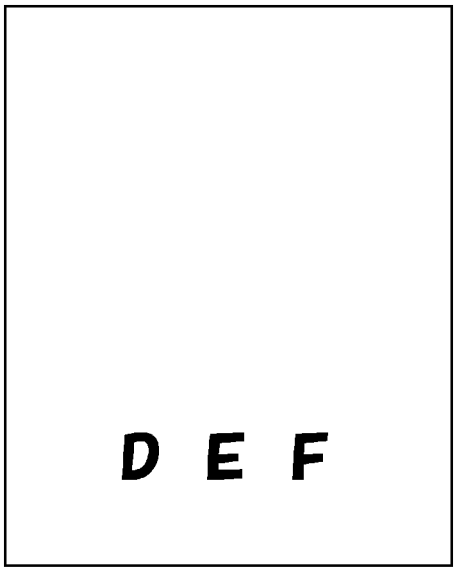
Figure 5C:
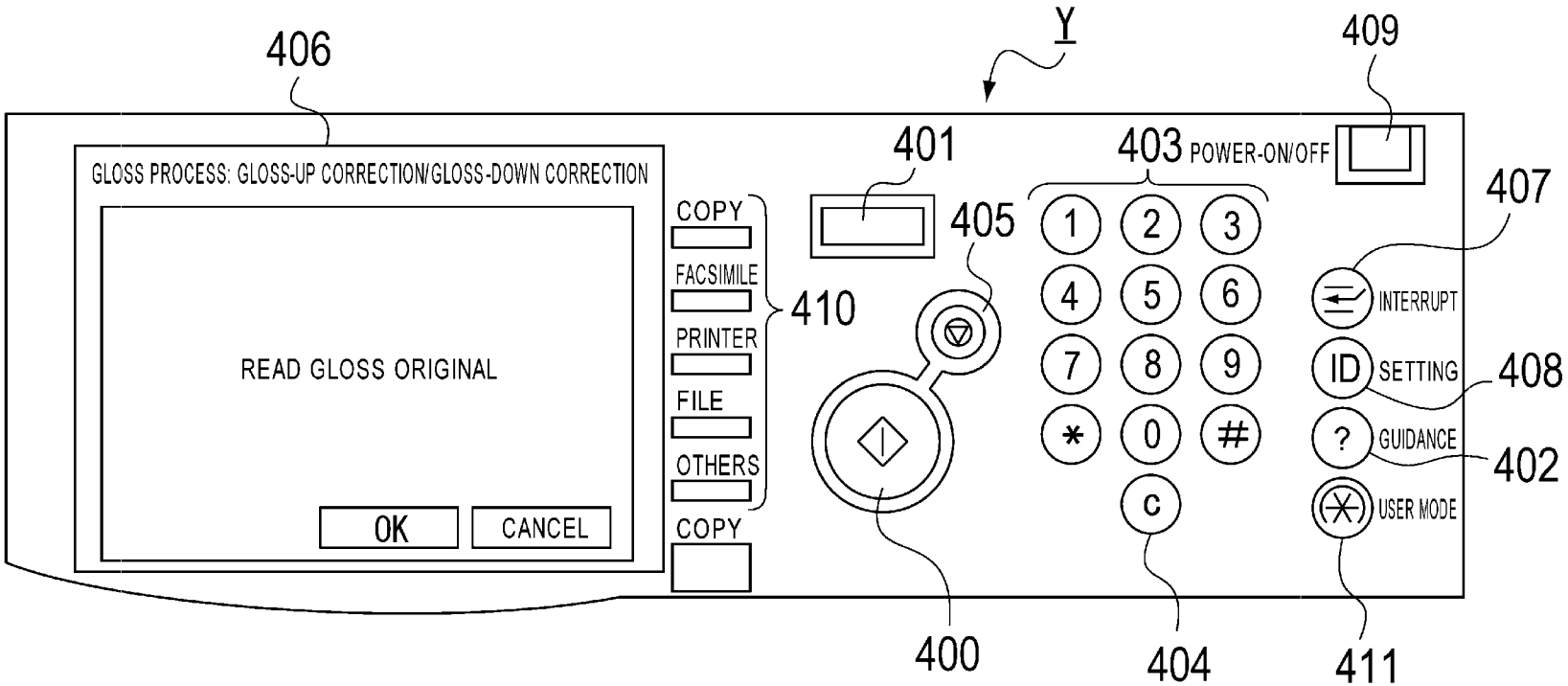
FIG. 5C is a plan view illustrating a configuration of the operation display.

FIG. 5A is a plan view illustrating a gloss-up specifying image, FIG. 5B is a plan view illustrating a gloss-down specifying image, and FIG. 5C is a plan view illustrating a configuration of the operation display Y when the gloss information is read. The following process will be described with reference to FIGS. 5A, 5B, and 5C. An instruction to "read the gloss original" illustrated in FIG. 5C is displayed on the touch panel 406. The user places the gloss-up specifying image illustrated in FIG. 5A or the gloss-down specifying image illustrated in FIG. 5B on the original reader X to press an "OK" key illustrated in FIG. 5C, thereby completing the read of the gloss information on the gloss original.

Figure 6A:
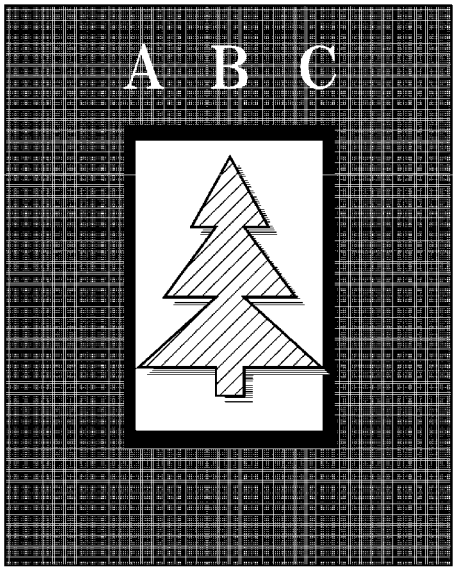
FIGS. 6A and 6B are plan views illustrating images whose glosses are increased and decreased, respectively.
Figure 6B:
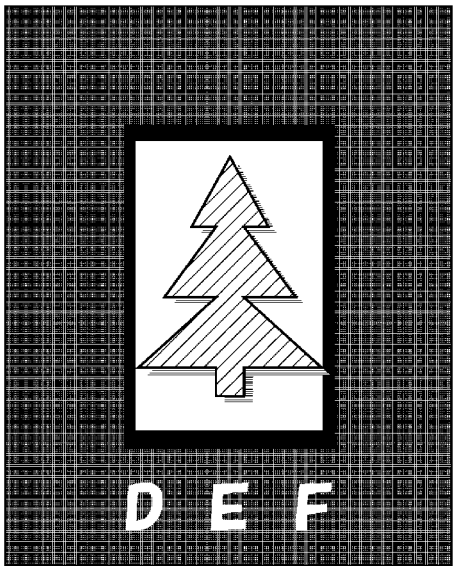

FIG. 6A is a plan view illustrating the image whose glosses are increased, and FIG. 6B is a plan view illustrating the image whose glosses are decreased. The following process will be described with reference to FIGS. 6A and 6B. Through the above-described operation, the pieces of image information on the YMCK (yellow, magenta, cyan, and black)+clear colors and the gloss information are obtained, and the image whose gloss is partly increased is obtained as illustrated in FIG. 6A. Alternatively, the image whose gloss is partly decreased is obtained as illustrated in FIG. 6B.

Figure 7A:
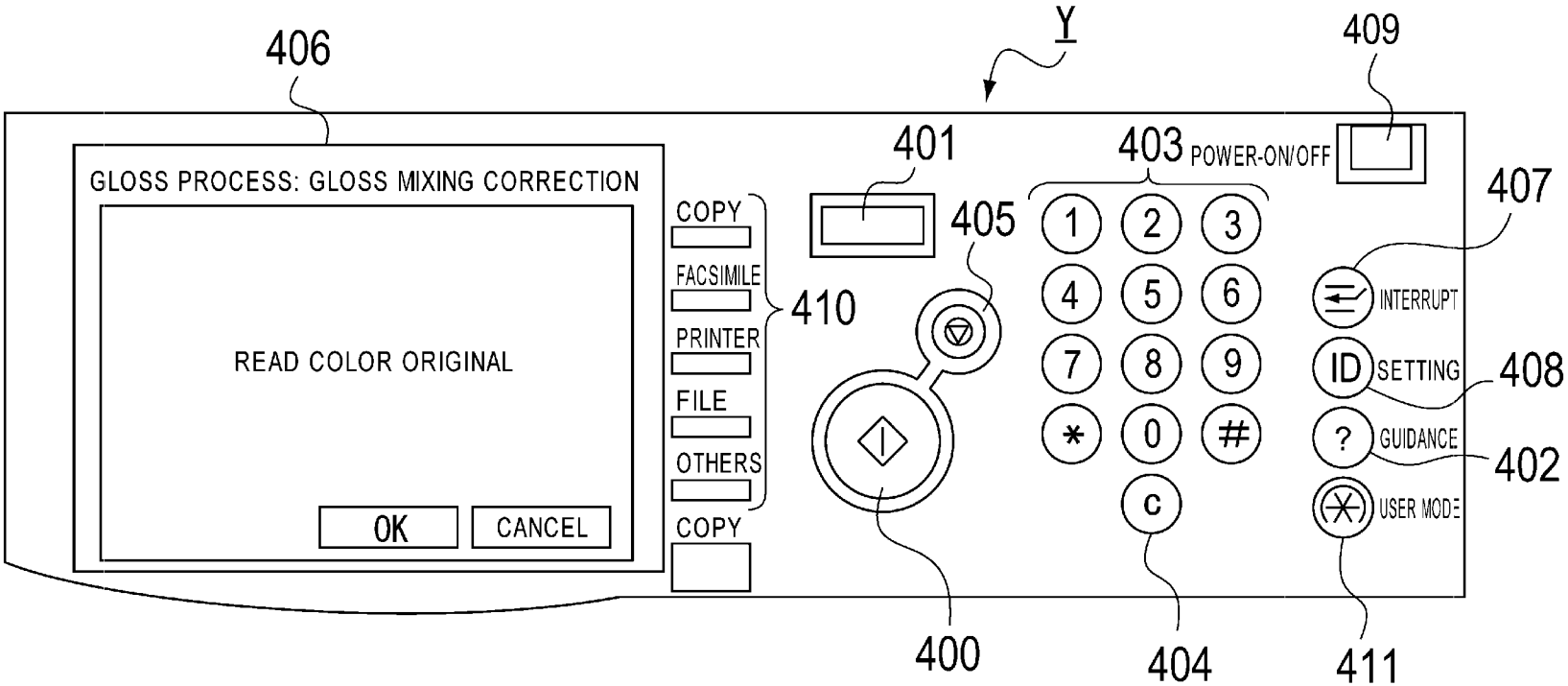
FIGS. 7A and 7B are plan views illustrating a configuration of the operation display when the color information is read.
Figure 7B:
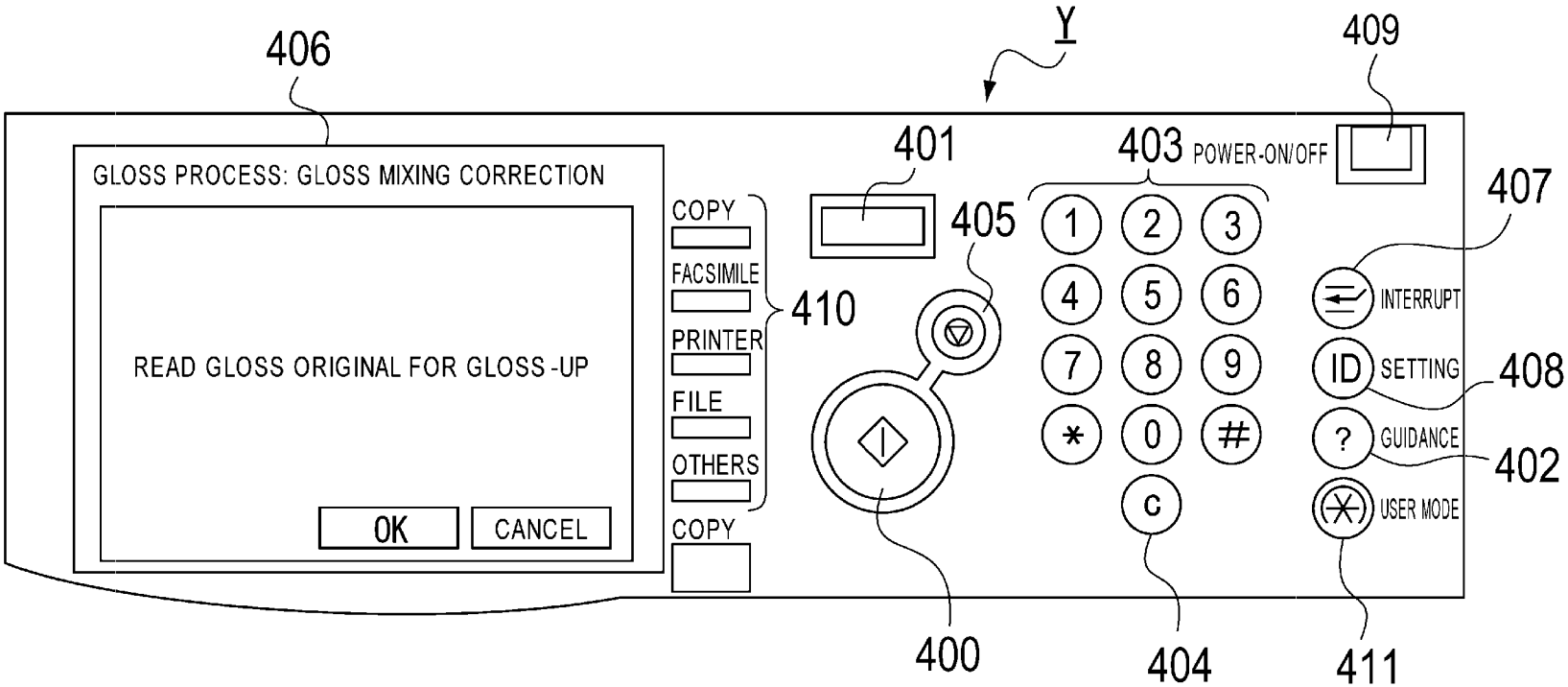
Figure 8A:
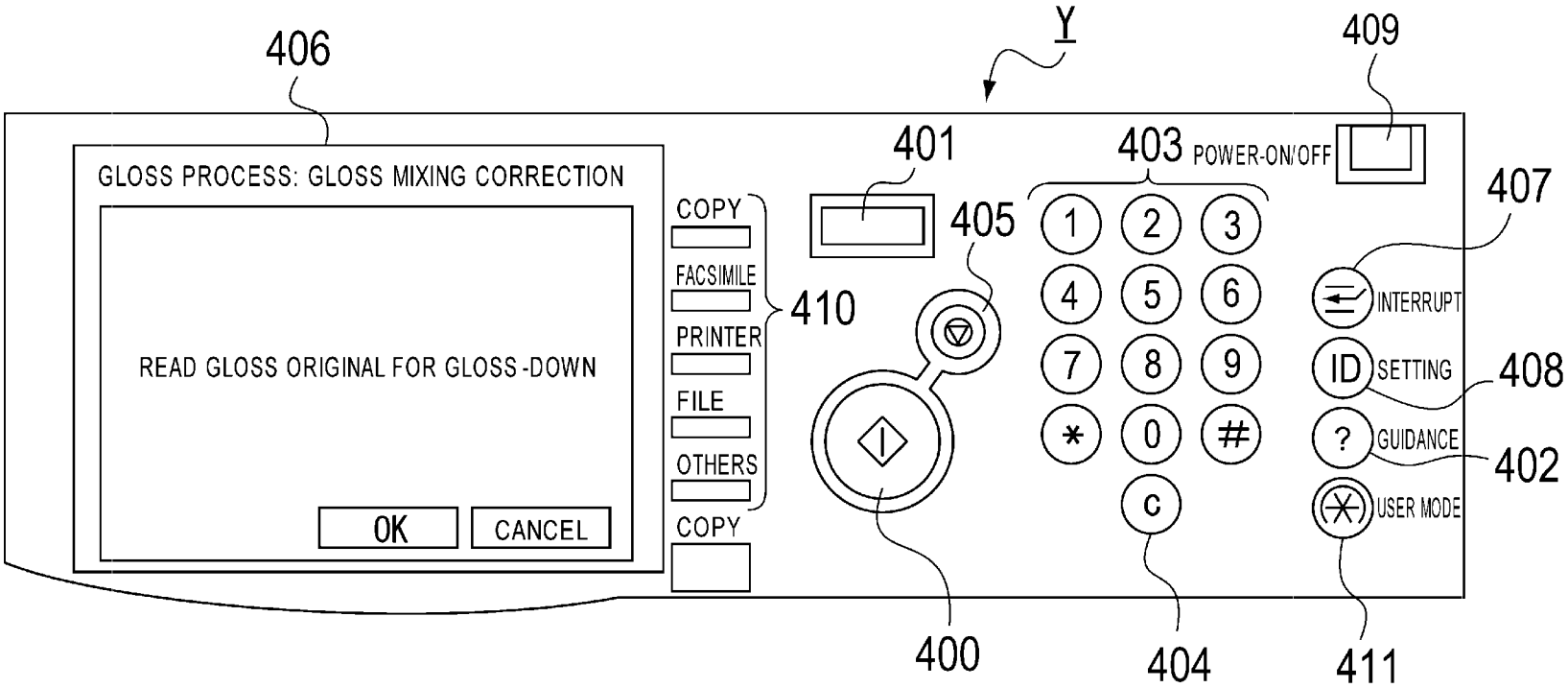
FIG. 8A is a plan view illustrating a configuration of the operation display when a gloss-down specifying image is read.
Figure 8B:
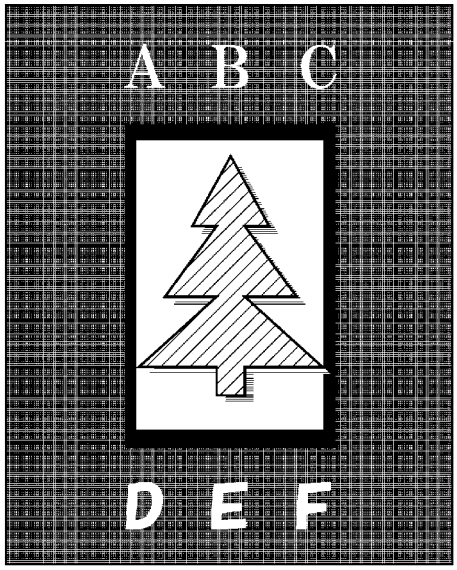
FIG. 8B is a plan view illustrating the gloss-down specifying image.

FIG. 7A is a plan view illustrating a configuration of the operation display Y when the color information is read, FIG. 7B is a plan view illustrating a configuration of the operation display Y when the gloss-up specifying image is read, and FIG. 8A is a plan view illustrating a configuration of the operation display Y when the gloss-down specifying image is read. FIG. 8B is a plan view illustrating an image in which the gloss is partly increased and decreased. The case in which the area where the gloss is increased, the area where the gloss is decreased, and the color image are obtained will be described with reference to FIGS. 7A, 7B, 8A, and 8B. For example, the user selects the gloss mixing correction key on the gloss process mode screen illustrated in FIG. 7A. Therefore, an instruction to "read the color original" illustrated in FIG. 7B is displayed on the touch panel 406. The user places the image illustrated in FIG. 4A on the original reader X to press the "OK" key illustrated in FIG. 7A, thereby completing the read of the color information on the color original.

Then an instruction to "read the gloss original for gloss-up" illustrated in FIG. 7B is displayed on the touch panel 406. The user places the gloss-up specifying image illustrated in FIG. 5A on the original reader X to press the "OK" key illustrated in FIG. 7B, thereby completing the read of the gloss information on the gloss original.

Then an instruction to "read the gloss original for gloss-down" illustrated in FIG. 8A is displayed on the touch panel 406. The user places the gloss-down specifying image illustrated in FIG. 5B on the original reader X to press the "OK" key illustrated in FIG. 8A, thereby completing the read of the gloss information on the gloss original.

Through the above-described operation, the pieces of image information on the YMCK (yellow, magenta, cyan, and black)+clear colors and the gloss information are obtained, and the image in which the area whose gloss is partly increased and the area whose gloss is partly decreased are mixed is obtained as illustrated in FIG. 8B.

In the printer mode, the personal computer that is the external host device 1000 produces the image to be output using image software with which the clear image or the gloss information is dealt. A Raster Image Processor (RIP) converts the produced image data into the pieces of image information on the YMCK (yellow, magenta, cyan, and black)+clear colors. At this point, the increase or decrease of the gloss of the produced gloss specifying area image can be specified on software. The image data converted into the image information on each color is converted into image information corresponding to an output device by a printer driver, an electric signal is transmitted to the apparatus main body 100A, and the image having the partly-different glosses can be obtained as illustrated in FIGS. 6A, 6B, and 8B.

Figure 9A:
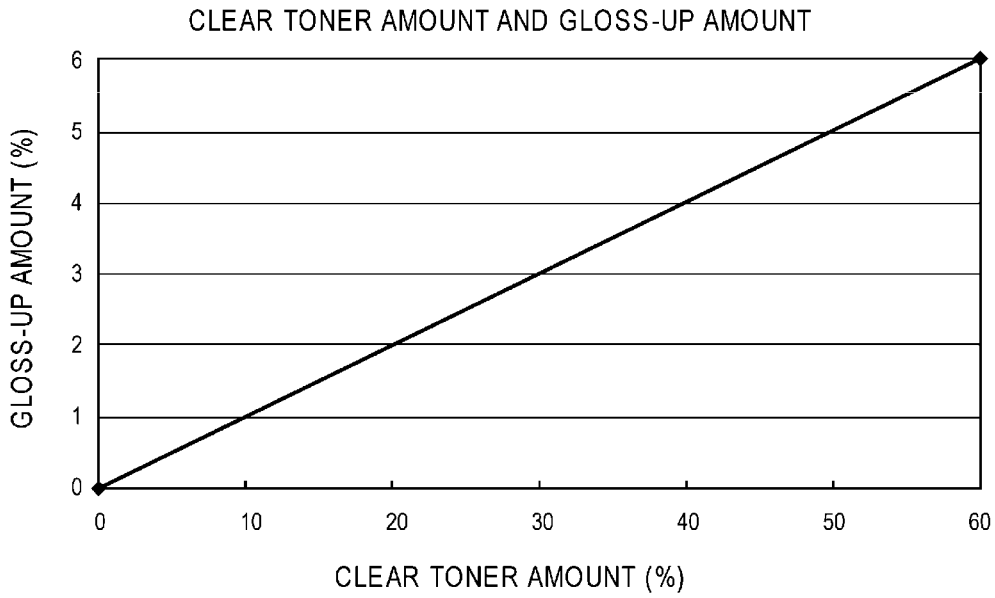
FIG. 9A is a graph illustrating a relationship between a clear toner amount and a gloss-up amount for a one-time fixing mode.

FIG. 9A is a graph illustrating a relationship between the clear toner amount and the gloss-up amount for the one-time fixing mode. The color toner and clear toner image forming processes and the fixing process in the case in which the user selects the gloss process mode will be described with reference to FIG. 9A. At this point, the case in which the gloss process mode selection key 450 is selected on the operation display Y in the copy mode is described in detail. The similar operation is performed when the gloss process signal is transmitted in the printer mode. The gloss specifying image that is distinguished or specified as a certain area is described by way of example. As illustrated in FIG. 9A, the similar operation is performed when the gloss specifying image is distinguished or specified as objects such as the character and the color information.

In the gloss process mode, the image is formed and fixed using the color toner and the clear toner. At this point, the color image data amount, the clear image data amount, and the image data amount in which the color image and the clear image are added are required. The image data amount is computed for all the pixels.

The control process performed by the controller K in the case in which the user selects the gloss process mode will be described with reference to FIG. 3. The controller K computes (processes) the total toner amount of the toner image formed on the recording material P based on the electric image information input from the image forming portions Pa to Pe or the external host device. The total toner amount is the color toner amount, the clear toner amount, and the color toner amount+clear toner amount. The image forming process and fixing process in the case in which the gloss is increased or decreased based on a certain area formed only by the color toner will be described below. The reference area is not limited to the following cases because the reference area can specify anywhere on the image forming surface.

(For Gloss-Up)

When the user selects the gloss process mode selection key 450, the mode keys of the gloss-up correction key, the gloss-down correction key, and the gloss mixing correction key are displayed on the touch panel 406. The case in which the user selects the gloss-up correction key 406*a* (see FIG. 2B) will be described.

As illustrated in FIG. 3, the controller K starts the gloss process mode (S1). The controller K receives one of a gloss-up correction signal, a gloss-down correction signal, and a gloss mixing correction signal as an instruction signal of the user from the touch panel 406 (S2). When receiving the gloss-up correction signal, the controller K starts the one-time fixing gloss-up output mode as the gloss process (S3). The controller K receives the color information and the gloss information, which are read by the original reader 4 (S4). The controller K estimates color toner amount (X1)+clear toner amount (X2) in each pixel (S5). Where a condition (1) of X1+X2≤240 is satisfied. The controller K causes the first to fifth image forming portions Pa to Pe to form the color toner image and the clear toner image in the specified area on the recording material P (S6). The recording material P is introduced to the fixing device 9, and the controller K causes the fixing device 9 to fix the color toner image and the clear toner image on the recording material P (S7). The gloss-up recording material P is output (S8).

At this point, in the area that is specified such that the gloss is increased, the image is formed such that the color toner load amount and the clear toner load amount are increased compared with other areas. The maximum total toner amount is set to 200% in the area where the image is formed only by the color toner, and the maximum total toner amount in which the color toner amount and the clear toner amount are added is set to 240%. For example, when the area where the image is formed only by the color toner has the maximum total toner amount of 180%, the image may be formed such that the total of the color toner load amount and the clear toner load amount becomes 240% or less.

Figure 9B:
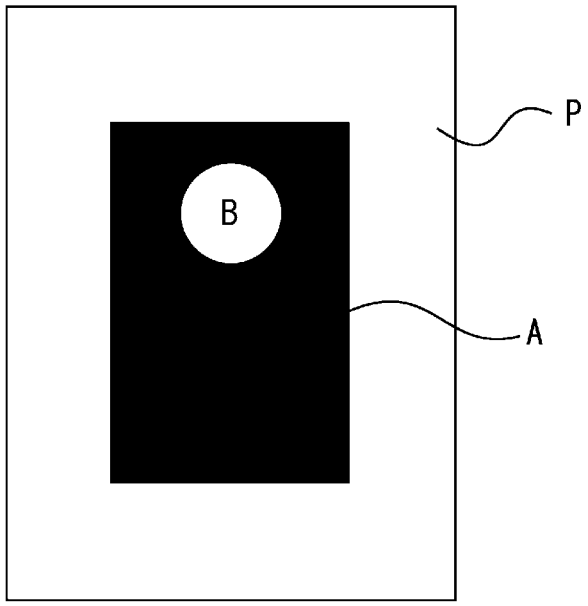
FIG. 9B is a plan view illustrating a state in which an image is formed on the recording material.

FIG. 9B is a plan view illustrating a state in which the image is formed on the recording material P. The description is made by way of example, and the invention is not limited to the state of FIG. 9B. In the image area illustrated in FIG. 9B, an area A is an image area of 190% that is formed only by the color toner. In the image area illustrated in FIG. 9B, an area B is specified such that the gloss is partly increased, and the area B is an image area that is formed by the color toner and the clear toner such that the total of the color toner and the clear toner becomes 240%. The area B is set such that the total toner amount is larger than that of other areas, and the total toner amount of the area B is set to 240%. In the area B, the color toner load amount is set to 190%, and the clear toner load amount is set to 50%. Assuming that X1 is the color toner load amount and X2 is the clear toner load amount, a correlation of X1+X2=240 holds in the area whose gloss is partly increased.

The load amount will supplementarily be described. The load amount means an amount of one color toner or the clear toner, which is loaded on the recording material P. For example, the amount of one color toner of 0.5 mm loaded on the recording material P is defined as 100%. For example, the amount of clear toner of 0.5 mm loaded on the recording material P is defined as 100%. In such cases, the color toner load amount of 190% means that the color toner of 0.95 mm (=0.5 mm×190%) is loaded on the recording material P. The clear toner load amount of 50% means that the clear toner of 0.25 mm (=0.5 mm×50%) is loaded on the recording material P.

As described above, in the area A, the image is formed and fixed only by the color toner load amount of 190%. On the other hand, in the area B, the image is formed and fixed while the clear toner load amount of 50% is added to the color toner load amount of 190%. Accordingly, in the area B, the gloss is increased by the clear toner load amount of 50%, by which the image is formed and fixed, compared with the area A. That is, the gloss level is increased by the clear toner.

Figure 10A:
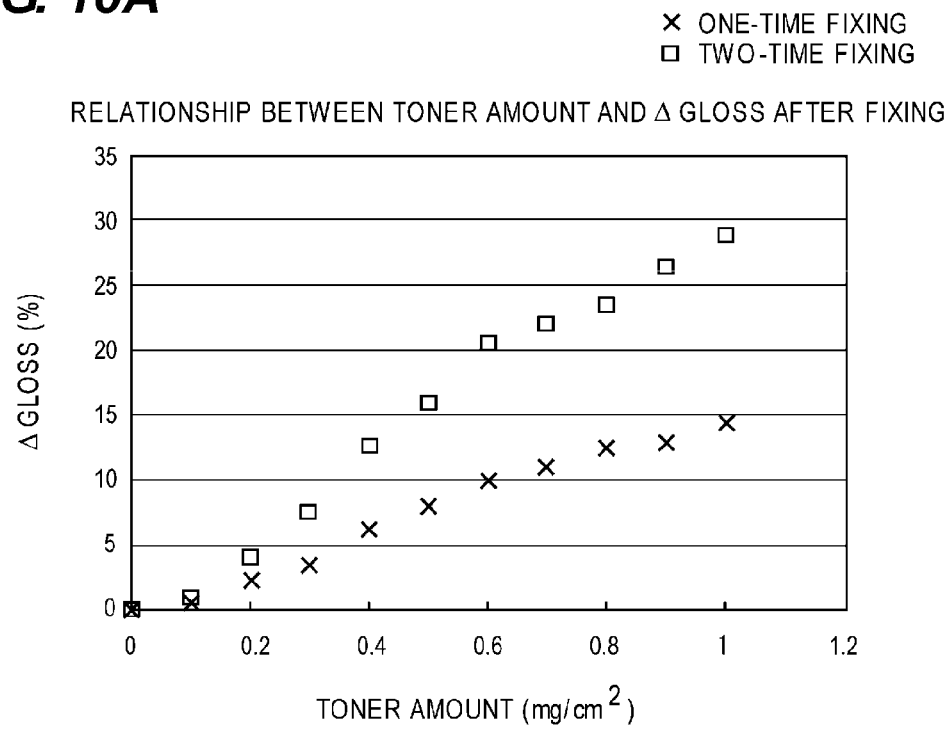
FIG. 10A is a graph illustrating a relationship between a toner amount and a gloss difference for the one-time fixing mode and a two-time fixing mode.

FIG. 10A is a graph illustrating a relationship between the toner amount and a gloss difference for the one-time fixing mode and the two-time fixing mode. As used herein, the gloss difference means a difference in gloss between the recording material P and the toner image surface. At this point, the plain paper having the basis weight of 80 g/m$^2$ and the paper gloss of about 6% is used for the recording material P. As illustrated in FIG. 10A, the gloss level is increased with increasing toner amount in the fixing device 9 that is designed such that the total toner amount can sufficiently be fixed once. Accordingly, the gloss of the specified area can be increased compared with other parts by the above-described setting. When the gloss-up correction key 406*a* is selected to end the read of the necessary color information and gloss information, the color toner amount and the clear toner amount are determined based on the equation (1) of X1+X2≤240.

Figure 10B:
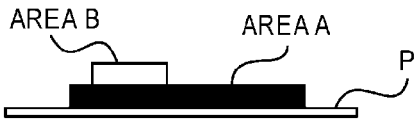
FIG. 10B is an enlarged sectional view illustrating a state in which a color toner image and a clear toner image are formed on the recording material.
Figure 10C:
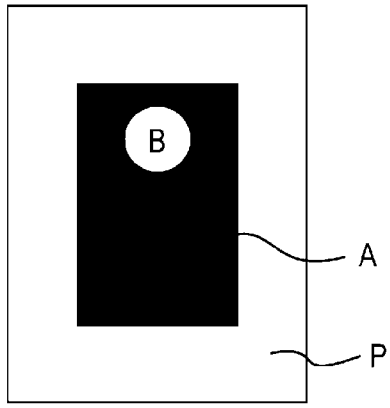
FIG. 10C is a plan view illustrating the state in which the color toner image and the clear toner image are formed on the recording material.

FIG. 10B is an enlarged sectional view illustrating a state in which the color toner image and the clear toner image are formed on the recording material P. In FIG. 10B, the area A is the color toner image, and the area B is the clear toner image. FIG. 10C is a plan view illustrating the state in which the color toner image and the clear toner image are formed on the recording material P. In FIG. 10C, the area A is the color toner image, and the area B is the clear toner image. As described above, after the color toner amount and the clear toner amount are determined, the image is formed by the color toner and the clear toner. As illustrated in FIGS. 10B and 10C, the toner image in which the color toner and the clear toner are loaded on the recording material P is formed, and the output whose gloss is partly increased can be obtained through the one-time fixing process. At this point, in the gloss information in FIG. 10C, the gloss of the area B becomes 16%, and the gloss of the area A becomes 12%.

The case in which the user selects the gloss-down correction key 406*b* (see FIG. 2B) in displaying the mode keys of the gloss-up correction key, the gloss-down correction key, and the gloss mixing correction key on the touch panel 406 will be described below.

As illustrated in FIG. 3, the controller K starts the gloss process mode (S1). The controller K receives one of a gloss-up correction signal, a gloss-down correction signal, and a gloss mixing correction signal as an instruction signal of the user from the touch panel 406 (S2). When receiving the gloss-down correction signal, the controller K starts the two-time fixing gloss-down output mode as the gloss process (S9).

The controller K receives the color information and the gloss information, which are read by the original reader 4 (S10). The controller K estimates color toner amount (X1) in each pixel (S11). Where a condition (2) of X1≤240 is satisfied. The controller K causes the second to fifth image forming portions Pb to Pe to perform the first image formation on the recording material P (S12). The recording material P is introduced to the fixing device 9, and the controller K causes the fixing device 9 to fix (first fixing) the color toner image on the recording material P (S13). The recording material P that is already subjected to the first image forming process and fixing process goes out from the fixing device 9, and a pathway of the recording material P is changed to an inversion re-feed mechanism by a selector (not illustrated) that is switched to a second posture (inversion posture). The recording material P that enters the inversion re-feed mechanism passes through a conveyance path without inversion, and is conveyed onto the intermediate transfer belt 130 from the registration roller 12 again.

The controller K estimates the clear toner amount (X2) in each pixel (S14). Where a condition (3) of X2≤240 is satisfied. The controller K causes the first image forming portion Pa to form the clear toner image on the recording material P by the clear toner (S15). The recording material P is introduced to the fixing device 9, and the controller K causes the fixing device 9 to fix (second fixing) the clear toner image on the recording material P (S16).

Through the control process, the clear toner image or the color toner image and the clear toner image are formed (second image formation) on the color toner image of the recording material P that is subjected to the first image forming process and fixing process. The recording material P is introduced to the fixing device 9 again to fix the toner image formed at the second time (second fixing).

During the second image formation, the image is formed by the clear toner in the area that is specified such that the gloss is decreased. In the present embodiment, the clear toner amount used in the second image formation is uniformly set to 100% irrespective of the first image formation. The toner amount of the clear toner image formed in the second image formation may be the fixable toner amount and be equal to or lower than 240%. The clear toner image is formed according to the first image such that the total toner amounts of the parts become equal to one another, whereby a step of the toner may be reduced.

Figure 11A:
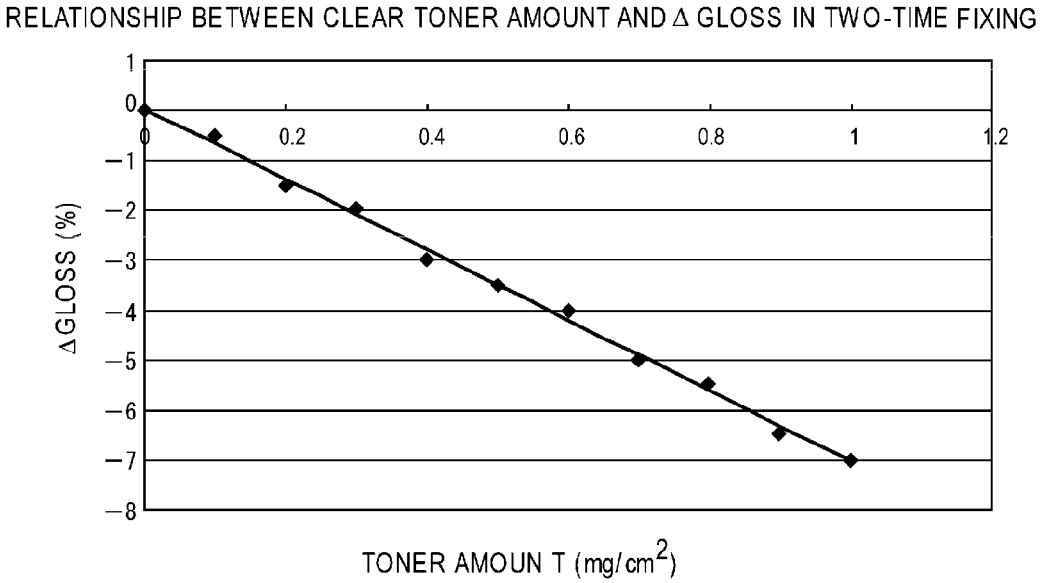
FIG. 11A is a graph illustrating a relationship between a clear toner amount and the gloss difference for the two-time fixing mode.
Figure 11B:
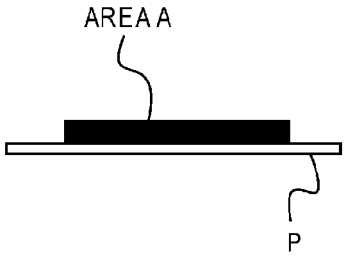
FIG. 11B is an enlarged sectional view illustrating a state in which only the color toner image is formed on the recording material.
Figure 11C:
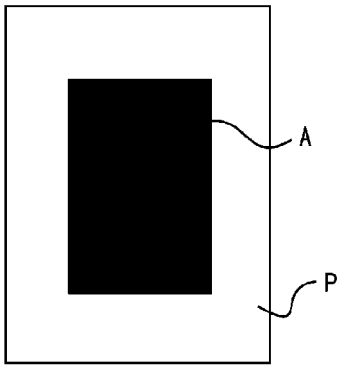
FIG. 11C is a plan view illustrating the state in which only the color toner image is formed on the recording material.
Figure 11D:
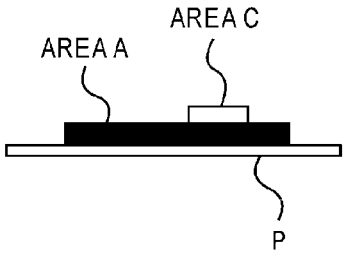
FIG. 11D is an enlarged sectional view illustrating a state in which the color toner image and the clear toner image are formed on the recording material.
Figure 11E:
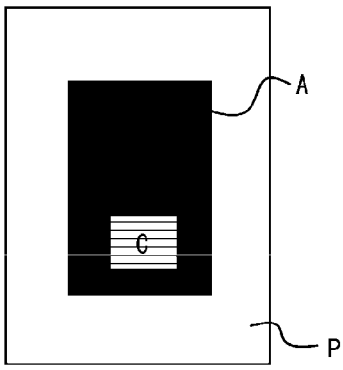
FIG. 11E is a plan view illustrating the state in which the color toner image and the clear toner image are formed on the recording material.

FIG. 11E is a plan view illustrating the state in which the images are formed on the recording material P. The description is made by way of example, and the invention is not limited to the state of FIG. 11E. In the image area illustrated in FIG. 11E, the area A is the image area of 190% that is formed only by the color toner. In the image area illustrated in FIG. 11E, an area C is specified such that the gloss is partly decreased, and the area C is an image area where the clear toner image of 100% is formed on the image surface to which only the color toner is fixed once.

In the present embodiment, the clear toner amount used in the second image formation is uniformly set to 100% irrespective of the first image formation. However, in the gloss process two-time fixing and output mode, the color toner image in the part in which the clear toner does not exist is fixed twice when the clear toner is formed on the first color toner image. On the other hand, because the part in which the clear toner is formed is subjected to the fixing process only once, the gloss in the image part in which the clear toner and the color toner are formed is lower than the gloss in the image part formed only by the color toner.

FIG. 11A is a graph illustrating a relationship between the clear toner amount and the gloss difference for the two-time fixing mode. As used herein, the gloss difference is a difference between a two-time fixing gloss and a one-time fixing gloss. The two-time fixing gloss is a gloss of the image that is formed only by the color toner fixed twice when the clear toner is formed on the surface to which the color toner image of 190% is fixed twice in the two-time fixing mode. The one-time fixing gloss is a gloss of the clear toner image that is formed on the color toner image and fixed once. At this point, the plain paper having the basis weight of 80 g/m$^2$ and the paper gloss of about 6% is used for the recording material P, and a measurement result is obtained when the gloss of the color image surface fixed twice is about 24%. FIG. 11A illustrates that the gloss level is decreased compared with other color toner areas when the clear toner amount is increased in forming the clear toner on the color toner. Accordingly, the gloss of the specified area can partly be decreased compared with other parts by the above-described setting.

FIG. 11B is an enlarged sectional view illustrating a state in which only the color toner image is formed on the recording material P. FIG. 11C is a plan view illustrating the state in which only the color toner image is formed on the recording material P. As described above, when the user selects the gloss-down correction key, the controller K ends the read of the necessary color information and gloss information, and estimates the color toner amount to determine the color toner amount (S11 of FIG. 3). When forming the image only by the color toner (S12 of FIG. 3), the controller K forms the toner image on which only the color toner is loaded on the recording material P and performs the first fixing (S13 of FIG. 3) as illustrated in FIGS. 11B and 11C. At this point, the gloss of the area A becomes 12% in the gloss information in FIG. 11C.

FIG. 11D is an enlarged sectional view illustrating a state in which the color toner image and the clear toner image are formed on the recording material P. FIG. 11E is a plan view illustrating the state in which the color toner image and the clear toner image are formed on the recording material P. As described above, the controller K estimates the clear toner amount to determine the clear toner amount (S14 of FIG. 3). When forming the clear toner image on the image subjected to the first fixing process (S15 of FIG. 3), the controller K forms the toner image on which the clear toner is loaded on the color toner and performs the second fixing (S16 of FIG. 3) as illustrated in FIGS. 11D and 11E. Therefore, the output whose gloss is partly decreased is obtained through the second fixing process. At this point, in the gloss information in FIG. 11E, the gloss of the area A becomes 16%, and the gloss of the area C becomes 13%.

(For Gloss Mixing Correction)

The case in which the user selects the gloss mixing correction key 406*c* (see FIG. 2B) in displaying the mode keys of the gloss-up correction key, the gloss-down correction key, and the gloss mixing correction key on the touch panel 406 will be described below.

As illustrated in FIG. 3, the controller K starts the gloss process mode (S1). The controller K receives one of the gloss-up correction signal, the gloss-down correction signal, and the gloss mixing correction signal as the instruction signal of the user from the touch panel 406 (S2). When the gloss mixing correction key is selected, the controller K is set to the gloss process two-time fixing high-and-low-gloss mixture output mode (S17). The controller K reads the color information and the gloss information (S18). The controller K estimates color toner amount (X1)+clear toner amount (X2) in each pixel (S19). Where the color toner amount (X1) and the clear toner amount (X2) are set to X1+X2≤240. The controller K causes the first to fifth image forming portions Pa to Pe to form the color toner image and the clear toner image on the recording material P by the clear toner and the color toner (S20). When the recording material P is introduced to the fixing device 9, the controller K causes the fixing device 9 to fix (first fixing) the color toner image and the clear toner image on the recording material P (S21).

The recording material P that is already subjected to the first image forming process and fixing process goes out from the fixing device 9, and the pathway of the recording material P is changed to the inversion re-feed mechanism by the selector (not illustrated) that is switched to the second posture. The recording material P that enters the inversion re-feed mechanism passes through the conveyance path without inversion, and is conveyed onto the intermediate transfer belt 130 from the registration roller 12 again.

The controller K estimates the clear toner amount (X2) in each pixel (S22). Where the clear toner amount (X2) is set in a range of X2≤240. The controller K causes the first image forming portion Pa to perform the second image formation on the recording material P by the clear toner (S23). When the recording material P is introduced to the fixing device 9, the controller K causes the fixing device 9 to fix (second fixing) the clear toner image on the recording material P (S24). In the second image formation, instead of the image singularly formed by the first image forming portion Pa, the second to fifth image forming portions Pb to Pe may form the color toner images while the first image forming portion Pa forms the clear toner image.

At this point, in the area that is specified such that the gloss is increased, the image is formed such that the color toner load amount and the clear toner load amount are increased compared with other areas during the first image formation. In the present embodiment, the maximum total toner amount is set to 200% in the area where the image is formed only by the color toner, and the maximum total toner amount in which the color toner amount and the clear toner amount are added is set to 240%. However, the invention is not limited to the present embodiment. For example, when the area where the image is formed only by the color toner has the maximum total toner amount of 180%, the image may be formed such that the total of the color toner load amount and the clear toner load amount becomes 240% or less.

During the second image formation, the image is formed by the clear toner in the area that is specified such that the gloss is decreased. In the present embodiment, the clear toner amount used in the second image formation is uniformly set to 100% irrespective of the first image formation. The toner amount of the clear toner image formed in the second image formation may be the fixable toner amount and be equal to or lower than 240%. The clear toner image is formed according to the first image such that the total toner amounts of the parts become equal to one another, whereby a step of the toner may be reduced.

Figure 12A:
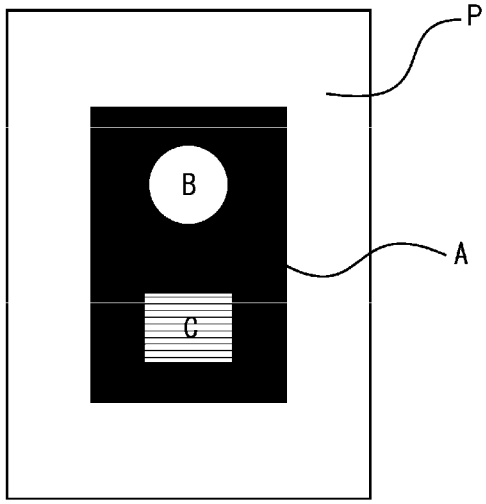
FIG. 12A is a plan view illustrating a configuration of an output having an area where the gloss is partly increased and an area where the gloss is partly decreased.

FIG. 12A is a plan view illustrating a configuration of an output having an area where the gloss is partly increased and an area where the gloss is partly decreased. FIG. 12A illustrates the state in which the images are formed by way of example. The description is made by way of example, and the invention is not limited to the state of FIG. 12A. In the image area illustrated in FIG. 12A, the area A is the image area of 190% that is formed only by the color toner. The area B is specified such that the gloss is partly increased, and the area B is the image area that is formed by the color toner and the clear toner such that the total of the color toner and the clear toner becomes 240%. The area C is specified such that the gloss is partly decreased, and the area C is the image area where the clear toner image of 100% is formed on the image surface to which only the color toner is fixed once.

In the area B where the gloss is partly increased, the total toner amount is set to 240% so as to be increased compared with other areas similarly to the gloss process one-time fixing gloss-up output mode. In the area B, the color toner load amount is set to 190%, and the clear toner load amount is set to 50%. Assuming that X1 is the color toner load amount and X2 is the clear toner load amount, the color toner load amount X1 and the clear toner load amount X2 are set such that an equation (4) of X1+X2=240 holds in the area whose gloss is partly increased.

In the area C where the gloss is partly decreased, the clear toner amount used in the second image formation is uniformly set to 100% irrespective of the first image formation similarly to the gloss process two-time fixing gloss-up output mode. However, there is no limitation to the clear toner amount used in the second image formation. The toner amount of the area C may be the fixable toner amount and be equal to or lower than 240%.

When the gloss mixing correction key is selected to end the read of the necessary color information and gloss information, the color toner amount and the clear toner amount are determined based on the estimation equation in order to determine the image in the first image forming process.

Figure 12B:
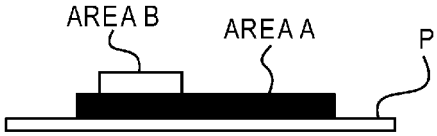
FIG. 12B is a sectional view illustrating a state in which an image is formed on the recording material by a color toner and a clear toner.
Figure 12C:
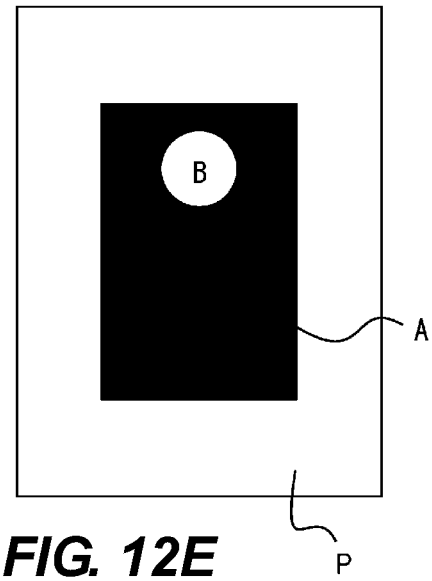
FIG. 12C is a plan view illustrating the state in which the image is formed on the recording material by the color toner and the clear toner.

FIG. 12B is a sectional view illustrating a state in which the image is formed on the recording material P by the color toner and the clear toner. FIG. 12C is a plan view illustrating the state in which the image is formed on the recording material P by the color toner and the clear toner. When the color toner image and the clear toner image are formed, the toner image in which the color toner and the clear toner are loaded on the recording material P is formed as illustrated in FIGS. 12B and 12C, and the output whose gloss is partly increased can be obtained through the one-time fixing process. At this point, in the gloss information in FIG. 12C, the gloss of the area B becomes 16%, and the gloss of the area A becomes 12%.

Figure 12D:
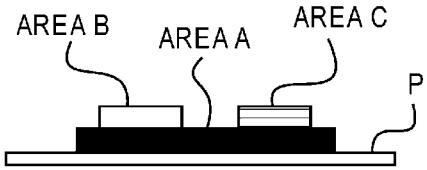
FIG. 12D is a sectional view illustrating a state in which an image is formed on the recording material by the clear toner.
Figure 12E:
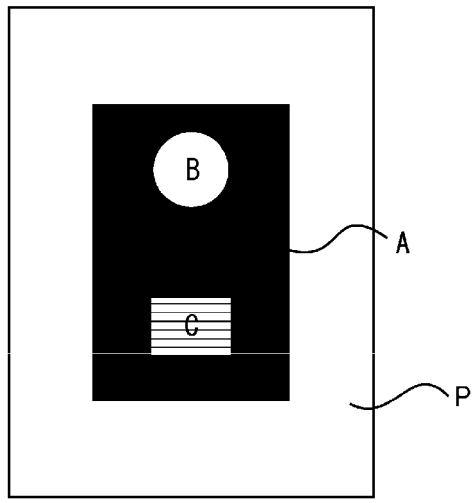
FIG. 12E is a plan view illustrating the state in which the image is formed on the recording material by the clear toner.

FIG. 12D is a sectional view illustrating a state in which the image is formed on the recording material P by the clear toner. FIG. 12E is a plan view illustrating the state in which the image is formed on the recording material P by the clear toner. Then, as described above, the clear toner amount is estimated to determine the clear toner amount. When the clear toner image is formed on the image surface subjected to the first fixing process, the state illustrated in FIGS. 12D and 12E is obtained. Therefore, the output whose gloss is partly decreased can be obtained through the second fixing process. At this point, in the gloss information in FIG. 12E, the gloss of the area B becomes 32%, the gloss of the area A becomes 25%, and the gloss of the area C becomes 19%.

The gloss level information on the image in pressing the gloss mixing correction key will be described in detail. When the toner image illustrated in FIG. 12B is formed, the image formed at the first time is subjected to the fixing process twice. At this point, the gloss depends on the toner amount. FIG. 9A illustrates a relationship between the gloss and the toner amount. In the present embodiment, the toner amount corresponding to the image data having the total toner amount of 240% including the color toner amount of 190% and the clear toner amount of 50%, namely, the toner amount of 0.96 $mg/cm^2$ is loaded in the area B. Accordingly, the toner amount is output after the two-time fixing process, and the toner amount becomes the gloss of about 30%. The toner amount corresponding to the image data having the color toner amount of 190%, namely, the toner amount of 0.72 $mg/cm^2$ is loaded in the area A. Accordingly, the toner amount is output after the two-time fixing process, and the toner amount becomes the gloss of about 24%.

On the other hand, for the part in which the clear toner image is formed like the area C of FIG. 12D, namely the image formed by the second image formation is subjected to the fixing process only once. At this point, the gloss depends on the toner amount. FIG. 11A illustrates a relationship between the toner amount and the gloss difference. In FIG. 11A, the clear toner of 100%, namely, the toner amount of 0.4 $mg/cm^2$ is loaded in the area C. The clear toner is output after the one-time fixing process, and becomes the gloss of about 18%.

Accordingly, the gloss of the specified area can be increased or decreased compared with other parts by the above-described setting.

In the image forming apparatus in which the image is formed by the color toner and the clear toner and fixed, the output controlled at the desired gloss level can be obtained by the use of the above-described configuration.

Second Embodiment

Figure 13A:
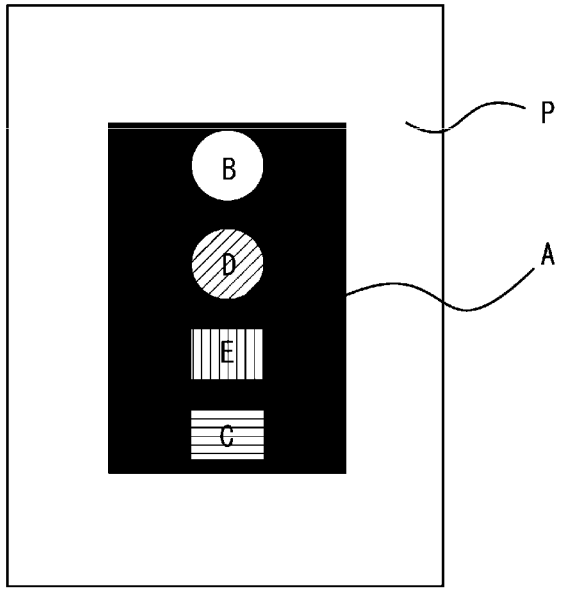
FIG. 13A is a sectional view illustrating an image having information on a gloss level of area B>area D>area A>area E>area C.

FIG. 13A is a plan view illustrating an image read by an image forming apparatus according to a second embodiment of the invention. In the image forming apparatus of the second embodiment, the same configuration as the image forming apparatus 100 of the first embodiment is designated by the same numeral, and the descriptions of the same configuration and effect are not appropriately described. The image forming apparatus of the second embodiment differs from the image forming apparatus of the first embodiment in the following point. That is, the gloss-up or the gloss-down can be controlled by a strength level when the gloss mixing correction key is selected.

The gloss specifying image that is distinguished or specified as a certain area is described by way of example. As illustrated in FIGS. 2B, 4B, 5C, and 7A, the similar operation is performed when the gloss specifying image is distinguished or specified as objects such as the character and the color information.

The color toner and clear toner image formation and fixing process in selecting the gloss mixing correction key will be described below. At this point, similarly to the first embodiment, the case in which the gloss process mode selection key 450 is selected on the operation display Y in the copy mode is described in detail. The similar operation is performed when the gloss process signal is transmitted in the printer mode.

FIG. 13A is a sectional view illustrating an image having information on a gloss level of area B>area D>area A>area E>area C. For example, the case in which the image having the gloss information illustrated in FIG. 13A is output will be described below. The image of FIG. 13A that is distinguished or specified as a certain area is described by way of example. The similar operation is performed when the image is distinguished or specified as objects such as the character and the color information.

In FIG. 13A, the area A is the area where the image is formed only by the color toner. The areas B and D are the areas where the gloss is specified higher than that of the area A, and the area B is the area where the gloss is specified higher than that of the area D. The areas C and E are the areas where the gloss is specified lower than that of the area A, and the area C is the area where the gloss is specified lower than that of the area E. That is, the gloss level information on each area becomes area B>area D>area A>area E>area C. In the present embodiment, the image is output with 5-level gloss level difference. However, there is no limitation to the gloss level difference.

Figure 13B:
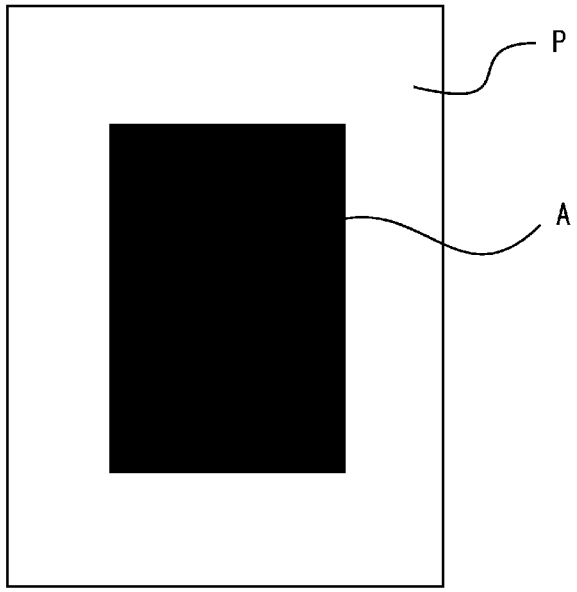
FIG. 13B is a plan view illustrating the image having the color information.

When the gloss mixing correction key is selected, similarly to the first embodiment, the screen on which the user is instructed to read the color information is displayed as illustrated in FIG. 7A. On the screen, the image illustrated in FIG. 13B is placed on the original reader to press the "OK" key of FIG. 7A, thereby completing the read of the color information. Then, the screen on which the user is instructed to read the gloss information for gloss-up is displayed as illustrated in FIG. 7B.

Figure 14A:
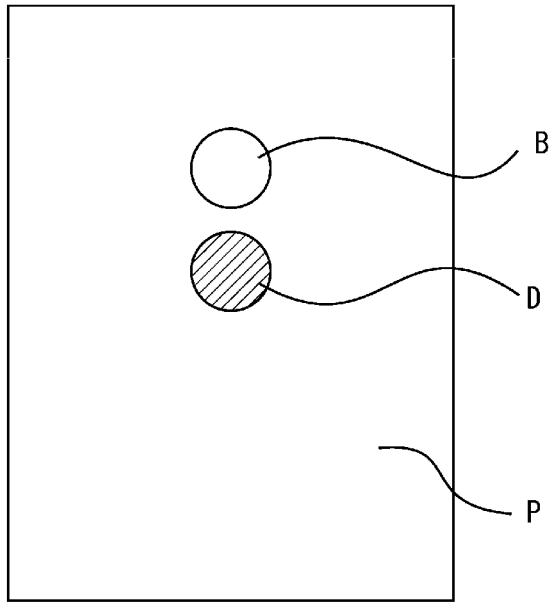
FIG. 14A is a plan view illustrating the gloss-up specifying image.

FIG. 14A is a plan view illustrating the gloss-up specifying image. The gloss-up specifying image illustrated in FIG. 14A is placed on the original reader X on the screen illustrated in FIG. 7B. The read of the gloss information for gloss-up is completed by pressing the "OK" key of FIG. 7B. At this point, for example, the gloss-up level can be read as density information on each image. That is, the gloss intensity in a certain area is recognized as a density difference.

Figure 14B:
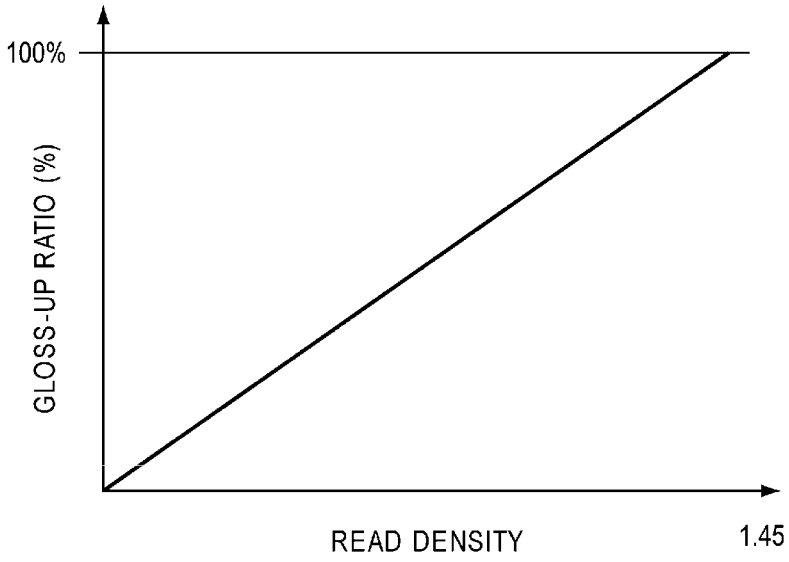
FIG. 14B is a graph illustrating a relationship between read density of the gloss-up specifying image and a gloss-up ratio of the output.

FIG. 14B is a graph illustrating a relationship between read density of the gloss-up specifying image and a gloss-up ratio of the output. As illustrated in FIG. 14B, read density of the gloss-up specifying image is directly proportional to the gloss-up ratio of the output. When the gloss difference between the image data amount in each pixel and the maximum image data amount is set to 100%, the gloss-up ratio is determined with respect to the gloss difference. In the present embodiment, assuming that the maximum image data amount is 240% and the image data amount in a certain pixel is 190%, because the gloss difference becomes about 6% (see FIG. 10A), the gloss-up amount is determined with respect to the gloss difference of 6%.

Then, the screen on which the user is instructed to read the gloss information for gloss-down is displayed as illustrated in FIG. 8A.

Figure 15A:
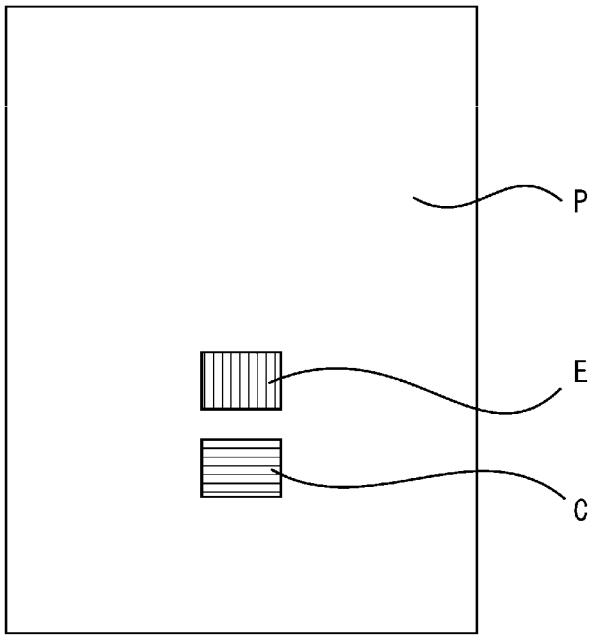
FIG. 15A is a plan view illustrating a gloss-down specifying image.

FIG. 15A is a plan view illustrating the gloss-down specifying image. The gloss-down specifying image illustrated in FIG. 15A is placed on the original reader on the screen illustrated in FIG. 8A. The read of the gloss information for gloss-down is completed by pressing the "OK" key of FIG. 8A. At this point, for example, the gloss-down level can be read as the density information on each image. That is, the gloss intensity in a certain area is recognized as the density difference.

Figure 15B:
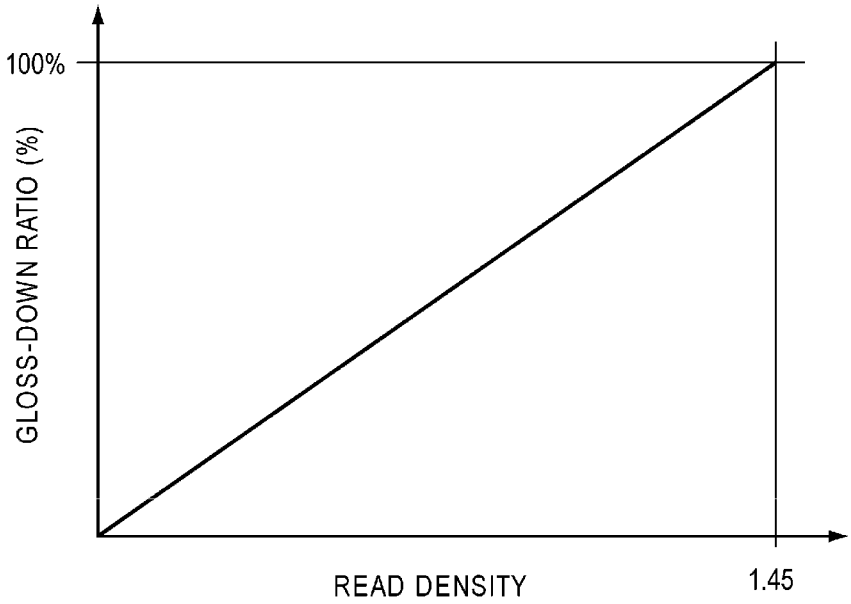
FIG. 15B is a graph illustrating a relationship between the read density of the gloss-down specifying image and a gloss-down ratio of the output.

FIG. 15B is a graph illustrating a relationship between the read density of the gloss-down specifying image to be read and the gloss-down ratio of the output. As used herein, the gloss-down amount is obtained when the gloss difference between the two-time fixing gloss and the one-time fixing gloss is set to 100%. The two-time fixing gloss is the gloss that is obtained when the toner corresponding to the image data amount in each pixel is subjected to the two-time fixing process. The one-time fixing gloss is the gloss that is obtained when the clear toner image of 100% is provided in the second image formation and fixed once onto the color toner fixed image. The gloss-down amount is used to determine the gloss-down ratio to the gloss difference. In the present embodiment, for example, because the gloss difference between the case in which the color toner image of 190% is fixed twice and the case in which the clear toner image of 100% is provided on the color toner image and fixed once is about 7%, the gloss-down amount is determined with respect to the gloss difference of 7%.

Figure 16:
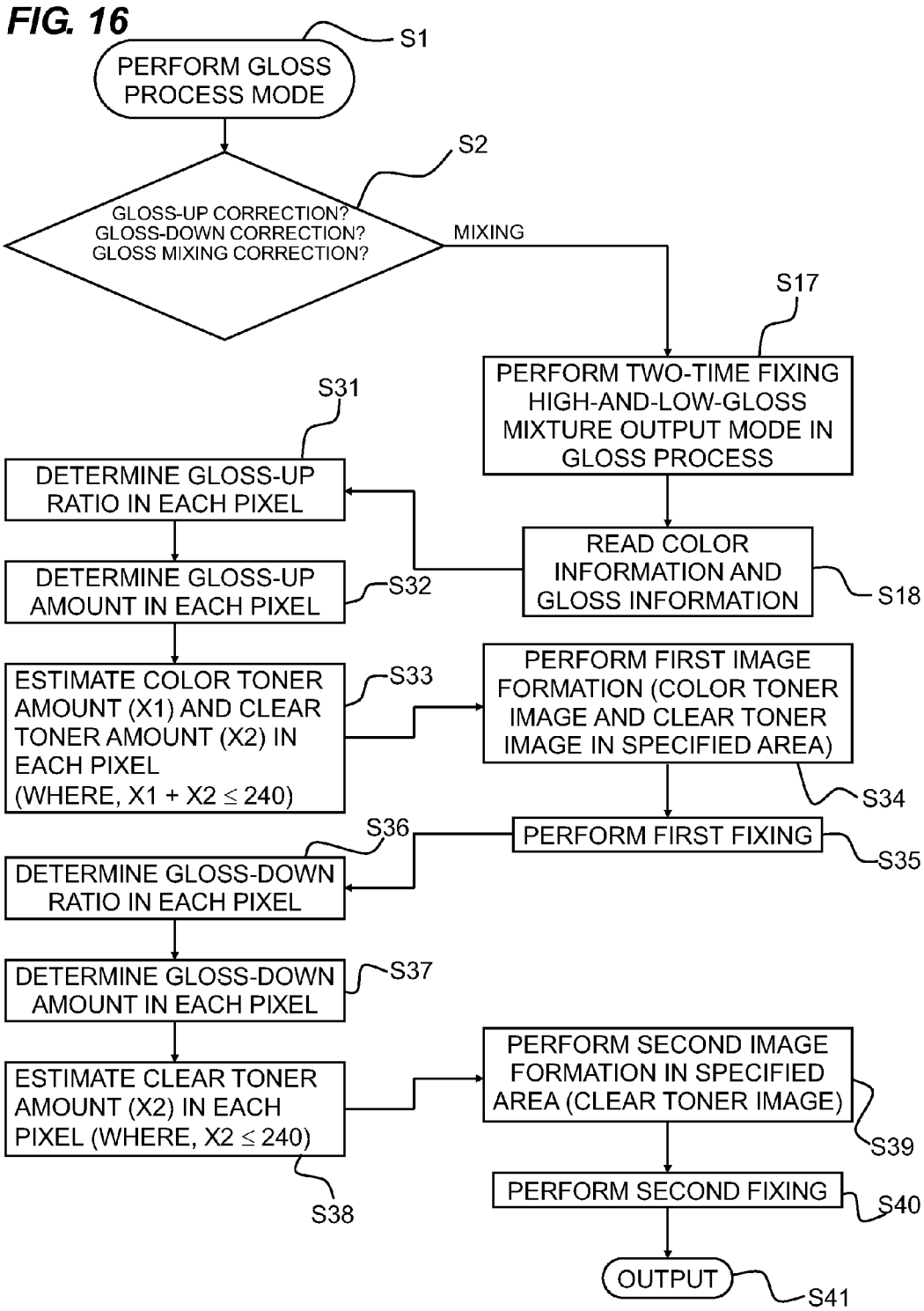
FIG. 16 is a flowchart illustrating a control process performed by the controller.

FIG. 16 is a flowchart illustrating a control process performed by the controller K. The controller K starts the gloss process mode (S1). The controller K determines which one of the gloss-up correction key, the gloss-down correction key, and the gloss mixing correction key is selected (S2). When determining that the gloss mixing correction key is selected, the controller K performs the gloss process (S17). The two-time fixing high-and-low-gloss mixture output mode is applied to the gloss process. The controller K reads the color information and the gloss information (S18).

The controller K determines the gloss-up ratio in each pixel (S31), and determines the gloss-up amount in each pixel (S32). The controller K estimates color toner amount (X1)+ clear toner amount (X2) in each pixel (S33). The controller K performs the first formation (S34). At this point, the controller K forms the color toner image+the clear toner image in the specified area (S34). The controller K performs the first fixing (S35).

The controller K determines the gloss-down ratio in each pixel (S36), and determines the gloss-down amount in each pixel (S37). The controller K estimates the clear toner amount (X2) in each pixel (S38). Where the clear toner amount (X2) is set in a range of X2≤240. The controller K performs the second image formation (S39). At this point, the controller K forms the clear toner image (S39). The controller K performs the second fixing (S40), and performs the output (S41).

Through the above-described operation, the pieces of image information on the YMCK (yellow, magenta, cyan, and black)+clear colors and the gloss information are obtained, and the image in which the area whose gloss is partly increased in a multilevel manner and the area whose gloss is partly decreased in a multilevel manner are mixed is obtained as illustrated in FIG. 13A.

In the printer mode, the personal computer that is the external host device 1000 produces the image to be output using image software with which the clear image or the gloss information is dealt. The Raster Image Processor (RIP) converts the produced image data into the pieces of image information on the YMCK (yellow, magenta, cyan, and black)+ clear colors. At this point, the increase or decrease of the gloss of the produced gloss specifying area image may be specified in the multilevel manner on software. The image data converted into the image information on each color is converted into image information corresponding to an output device by the printer driver, the electric signal is transmitted to the apparatus main body 100A, and the image having the partly-different glosses can be obtained as illustrated in FIG. 13A.

The color toner and clear toner image formation and fixing process in selecting the gloss mixing correction key in the present embodiment will be described below.

When the gloss mixing correction key is selected, the image is output by the gloss process two-time fixing high-and-low-gloss mixture output mode. First, the first to fifth image forming portions Pa to Pe form the clear toner image and the color toner image on the recording material P. When the recording material P is introduced to the fixing device 9, the color toner image and the clear toner image are fixed (first fixing). The recording material P that is already subjected to the first image forming process and fixing process goes out from the fixing device 9, and the pathway of the recording material P is changed to the inversion re-feed mechanism by the selector (not illustrated) that is switched to the second posture. The recording material P that enters the inversion re-feed mechanism passes through the conveyance path without inversion, and is conveyed onto the intermediate transfer belt 130 from the registration roller 12 again. The first image forming portion Pa forms the clear toner image. Alternatively, the first image forming portion Pa forms the clear toner image and the second to fifth image forming portions Pb to Pe form the color toner images. Therefore, the clear toner image is formed (second image formation) on the color toner image and the clear toner image of the recording material P that is already subjected to the first image forming process and fixing process. The recording material P is introduced to the fixing device 9 again to fix the toner image formed at the second time (second fixing).

At this point, in the area that is specified such that the gloss is increased, the image is formed such that the color toner load amount and the clear toner load amount are increased compared with other areas during the first image formation. In the present embodiment, the maximum total toner amount is set to 200% in the area where the image is formed only by the color toner, and the maximum total toner amount in which the color toner amount and the clear toner amount are added is set to 240%. However, the invention is not limited to the present embodiment. For example, when the area where the image is formed only by the color toner has the maximum total toner amount of 180%, the image may be formed such that the total of the color toner load amount and the clear toner load amount becomes 240% or less.

During the second image formation, the image is formed by the clear toner in the area that is specified such that the gloss is decreased. The toner amount of the clear toner image formed in the second image formation may be the fixable toner amount and be equal to or lower than 240%.

The case in which the image having the gloss level information illustrated in FIG. 13A is output will be described by way of example. The description is made by way of example, and the invention is not limited to the state of FIG. 13A.

In the image area illustrated in FIG. 13A, the area A is the image area of 190% that is formed only by the color toner. The area B is specified such that the gloss is partly increased, and the area B is the image area that is formed by the color toner of 190% and the clear toner of 50% such that the total of the color toner and the clear toner becomes 240%. The area D is specified such that the gloss is partly weakly increased, and is the image area that is formed by the color toner of 190% and the clear toner of 20% such that the total of the color toner and the clear toner becomes 210%. The area C is specified such that the gloss is partly decreased, and the area C is the image area where the clear toner image of 100% is formed on the image surface to which only the color toner is fixed once. The area E is specified such that the gloss is partly weakly decreased, and is the image area where the clear toner image of 50% is formed on the image surface to which only the color toner is fixed once.

Figure 17A:
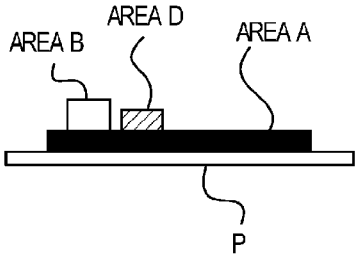
FIG. 17A is a sectional view illustrating an image based on the gloss-up information such as the area B and the area D.
Figure 17B:
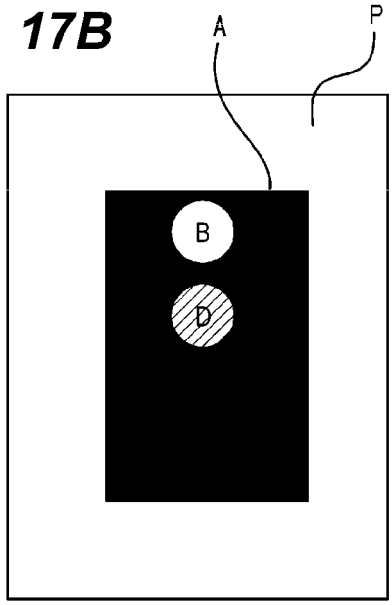
FIG. 17B is a plan view illustrating the image based on the gloss-up information such as the area B and the area D.

FIG. 17A is a sectional view illustrating an image based on the gloss-up information such as the area B and the area D. FIG. 17B is a plan view illustrating the image based on the gloss-up information such as the area B and the area D. The gloss level information on the image in pressing the gloss mixing correction key will be described in detail with reference to FIGS. 17A and 17B. When the image illustrated in FIG. 17A is formed, namely, the image formed at the first time is subjected to the fixing process twice. At this point, the gloss depends on the toner amount. FIG. 10A illustrates the relationship between the gloss and the toner amount. In the present embodiment, the toner amount corresponding to the image data having the total toner amount of 240% including the color toner amount of 190% and the clear toner amount of 50%, namely, the toner amount of 0.96 mg/cm$^2$ is loaded in the area B. The toner amount corresponding to the image data having the total toner amount of 210% including the color toner amount of 190% and the clear toner amount of 20%, namely, the toner amount of 0.84 mg/cm$^2$ is loaded in the area D. Accordingly, the toner amount is output after the two-time fixing process, the toner amount becomes the gloss of about 30% in the area B, and the toner amount becomes the gloss of about 26% in the area D.

The toner amount corresponding to the image data having the color toner amount of 190%, namely, the toner amount of 0.76 mg/cm$^2$ is loaded in the area A. Accordingly, the toner amount is output after the two-time fixing process, and the toner amount becomes the gloss of about 24%.

Figure 17C:
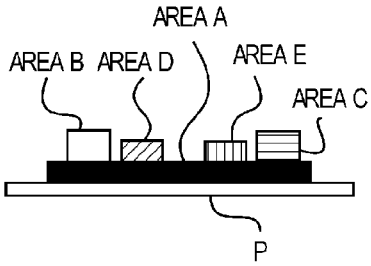
FIG. 17C is a sectional view illustrating an image based on the gloss-up information such as the area B and the area D and the gloss-down information such as the area E and the area C.
Figure 17D:
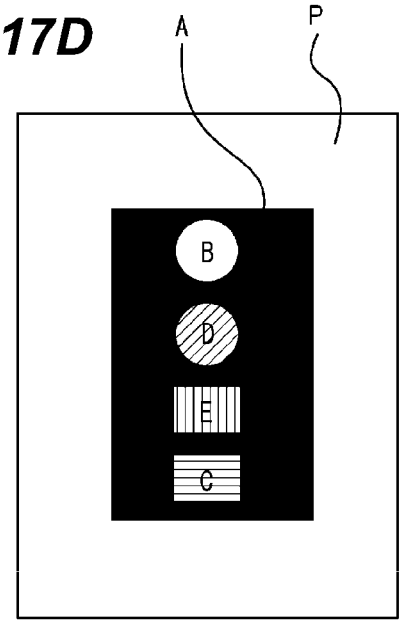
FIG. 17D is a plan view illustrating the image based on the gloss-up information such as the area B and the area D and the gloss-down information such as the area E and the area C.

FIG. 17C is a sectional view illustrating an image based on the gloss-up information such as the area B and the area D and the gloss-down information such as the area E and the area C. FIG. 17D is a plan view illustrating the image based on the gloss-up information such as the area B and the area D and the gloss-down information such as the area E and the area C.

On the other hand, for the part in which the clear toner image is formed like the areas C and E of FIG. 7D, namely the image formed by the second image formation is subjected to the fixing process only once. At this point, the gloss depends on the toner amount. FIG. 11A illustrates the relationship between the toner amount and the gloss difference. In the present embodiment, the clear toner of 100%, namely, the toner amount of 0.4 mg/cm$^2$ is loaded in the area C. The clear toner of 50%, namely, the toner amount of 0.2 mg/cm$^2$ is loaded in the area E. Accordingly, the clear toner is output after the one-time fixing process, the clear toner becomes the gloss of about 18% in the area C, and the clear toner becomes the gloss of about 21% in the area E.

In the area where the gloss is partly increased, the gloss-up level is expressed by the difference between the total toner amount of the color toner and the clear toner and the toner amount of only the color toner. In the present embodiment, as illustrated in FIG. 9A, the gloss of the color toner image of 190% can be increased by increasing the clear toner load amount based on the gloss of the color toner image fixed twice. FIG. 9A illustrates a gloss-up level based on the gloss of the surface in which the toner image of 190% is fixed twice. Accordingly, the gloss can widely be controlled by adjusting the clear toner load amount such that the desired gloss is obtained.

In the area where the gloss is partly decreased, as described above, when the clear toner amount is loaded on the image surface fixed once, the image surface fixed twice differs from the image surface fixed once in a provided heat quantity, thereby expressing the gloss-down level. For example, in the process of loading the clear toner on the surface to which the color toner image of 190% is fixed once, as illustrated in FIG. 11A, the gloss of the color toner image can be decreased by increasing the clear toner load amount based on the gloss of the image surface fixed twice. FIG. 11A illustrates a gloss-down level based on the gloss of the surface in which the toner image of 190% is fixed twice. Accordingly, the gloss can widely be controlled by adjusting the clear toner load amount such that the desired gloss is obtained.

Accordingly, the gloss of the specified area can be increased or decreased compared with other parts by the above-described setting, and the gloss-up level and the gloss-down level can also be adjusted.

In the image forming apparatus in which the image is formed by the color toner and the clear toner and fixed, the output controlled at the desired gloss level can be obtained by the use of the above-described configuration.

According to the configurations of the first and second embodiments, the output including the area where the gloss level is partly increased compared with the surroundings is obtained for the gloss-up correction. According to the configurations of the first and second embodiments, the output including the area where the gloss level is partly decreased compared with the surroundings is obtained for the gloss-down correction. According to the configurations of the first and second embodiments, the output including the area where the gloss level is partly increased and the area where the gloss level is partly decreased compared with the surroundings is obtained for the gloss mixing correction. As a result, the output whose gloss level is widely controlled is obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-159467, filed Jul. 14, 2010, which is hereby incorporated by reference herein in its entirety.

What is claimed is:

1. An image forming apparatus comprising:

an image forming portion configured to form a full-color toner image and a transparent toner image on a sheet;

a fixing portion configured to heat-fix the full-color toner image and the transparent toner image on the sheet formed by the image forming portion;

a sheet conveying portion configured to convey the sheet, of which the full-color toner image and the transparent toner image are formed at a first time and which is passed through the fixing portion, toward the image forming portion to form the transparent toner image on the sheet at a second time without an inversion operation of the sheet;

an obtaining portion configured to obtain information corresponding to a first area where a gloss level should relatively and partly be increased in the full-color toner image on the sheet and a second area where the gloss level should relatively and partly be decreased in the full-color toner image on the sheet; and a controlling portion configured to control the image forming portion, wherein when the transparent toner images are formed on the first area and the second area of the sheet respectively based on the information obtained by the obtaining portion, the controlling portion controls the image forming portion to form the transparent toner image on the first area in the sheet at the first time, and form the transparent toner image on the second area in the sheet at the second time.

2. The image forming apparatus according to claim 1, wherein the controlling portion controls a transparent toner amount per unit area of the transparent toner image on the first area based on the gloss level including the information obtained by the obtaining portion.

3. The image forming apparatus according to claim 2, wherein the controlling portion controls a transparent toner amount per unit area of the transparent toner image on the second area based on the gloss level including the information obtained by the obtaining portion.

4. The image forming apparatus according to claim 1, wherein the controlling portion controls a transparent toner amount per unit area of the transparent toner image on the second area based on the gloss level including the information obtained by the obtaining portion.

5. The image forming apparatus according to claim 1, wherein the image forming portion forms the full-color toner image using yellow toner, a magenta toner, a cyan toner and a black toner.

6. The image forming apparatus according to claim 5, wherein the image forming portion includes (i) four image forming devices configured to form the yellow toner image, the magenta toner image, the cyan toner image and the black toner image on four photosensitive members respectively, (ii) a transparent image forming device configured to form the transparent toner image on a photosensitive member, and (iii) an intermediate transfer member configured (a) for the transparent toner image, the yellow toner image, the magenta toner image, the cyan toner image and the black toner image to be transferred thereon from the photosensitive members, and (b) to transfer the transparent toner image, the yellow toner image, the magenta toner image, the cyan toner image and the black toner image onto the sheet at the first time, and wherein the yellow toner image, the magenta toner image, the cyan toner image and the black toner image are transferred on the transparent toner image which is transferred on the intermediate transfer member at the first time to provide the transparent toner image with the full-color toner image in the sheet.

7. The image forming apparatus according to claim 1, wherein the fixing portion includes a pair of rotating members configured to form a nip portion for nipping and conveying the sheet to apply heat and pressure.

8. The image forming apparatus according to claim 1, further comprising a designating portion configured to designate a gloss-mixing mode, by an operator, in which a gloss level should relatively and partly be increased and decreased in the full-color toner image on the sheet, wherein when the gloss-mixing mode is designated, the controlling portion controls the image forming portion to form the transparent toner image on the first area in the sheet at the first time and on the second area in the sheet at the second time.

9. The image forming apparatus according to claim 8, wherein the designating portion is able to designate a gloss-up mode in which a gloss level should relatively and partly be increased in the full-color toner image on the sheet, and a gloss-down mode in which a gloss level should relatively and partly be decreased in the full-color toner image on the sheet, wherein when the gloss-up mode is designated, the controlling portion controls the image forming portion to form the transparent toner image on the sheet at the first time, and wherein when the gloss-down mode is designated, the controlling portion controls the image forming portion to form the transparent toner image on the sheet at the second time.

* * * * *